US009174472B2

(12) United States Patent
Kawai et al.

(10) Patent No.: US 9,174,472 B2
(45) Date of Patent: Nov. 3, 2015

(54) PRINTER

(71) Applicant: Brother Kogyo Kabushiki Kaisha, Nagoya-shi, Aichi-ken (JP)

(72) Inventors: Junya Kawai, Kiyosu (JP); Naoki Tanjima, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/631,528

(22) Filed: Feb. 25, 2015

(65) Prior Publication Data

US 2015/0246561 A1 Sep. 3, 2015

(30) Foreign Application Priority Data

Feb. 28, 2014 (JP) ..... 2014-039852

(51) Int. Cl.

| | |
|---|---|
| ***B41J 29/38*** | (2006.01) |
| ***B41J 15/00*** | (2006.01) |
| ***B41J 11/66*** | (2006.01) |
| ***B41J 11/00*** | (2006.01) |

(52) U.S. Cl.

CPC ..... *B41J 15/00* (2013.01); *B41J 11/0075* (2013.01); *B41J 11/663* (2013.01)

(58) Field of Classification Search

CPC ..... B41J 15/00; B41J 11/0075; B41J 11/663
See application file for complete search history.

(56) References Cited

U.S. PATENT DOCUMENTS

| | | | | |
|---|---|---|---|---|
| 7,009,723 | B1 * | 3/2006 | Bartholet et al. | 358/1.15 |
| 2009/0217835 | A1 * | 9/2009 | Rozenblum | 101/484 |
| 2010/0310294 | A1 * | 12/2010 | Tsugaru et al. | 400/583 |

FOREIGN PATENT DOCUMENTS

| | | | |
|---|---|---|---|
| JP | 2000-313558 | A | 11/2000 |
| JP | 2006-193259 | A | 7/2006 |

* cited by examiner

*Primary Examiner* — Julian Huffman
(74) *Attorney, Agent, or Firm* — Banner & Witcoff, Ltd.

(57) ABSTRACT

The disclosure discloses a printer comprising a take-up portion, a first memory, a consumed amount calculating portion, a first correcting portion, an operation signal input portion, and a second correcting portion. The take-up portion takes up a recording medium on which printing was performed by the printing head. The first memory stores a value related to a remaining amount or a consumed amount of the recording medium. The consumed amount calculating portion calculates a first consumed amount based on a fed amount by the feeder. The first correcting portion corrects the value stored in the first memory by the first consumed amount. The second correcting portion corrects the value r stored in the first memory by using a predetermined second consumed amount, triggered by input of the operation signal to the operation signal input portion.

9 Claims, 18 Drawing Sheets

FIG. 15

| MEDIUM | TAPE LENGTH CORRECTION VALUE [MM] |
|---|---|
| PAPER TAPE | 150 |
| PET TAPE | 200 |
| CLOTH TAPE | 250 |
| CRAFT TAPE | 250 |

PRINTER

CROSS-REFERENCE TO RELATED APPLICATION

The present application claims priority from Japanese Patent Application No. 2014-039852, which was filed on Feb. 28, 2014, the disclosure of which is incorporated herein by reference in its entirety.

BACKGROUND

1. Field

The present disclosure relates to a printer that perform printing on a long recording medium.

2. Description of the Related Art

There are known printers that perform printing on a recording medium. In this printer of prior art, storage means that stores a remaining amount of the recording medium is provided. When printing is executed on the recording medium, the consumed amount of the recording medium is calculated based on a fed amount of the recording medium resulting from feeding means. Further, the remaining amount of the recording medium stored in the storage means is read, and corrected by the calculated consumed amount. After printing is completed, the corrected consumed amount is written to the storage means.

However, as one type of printer, there is a configuration wherein a printed matter is generated by performing printing on the long recording medium fed out from a roll, and then further taking up the recording medium by take-up means. In such a case, as a preparation operation prior to the start of generation of the printed matter, a tip end of the recording medium on the transport direction downstream side, positioned on the outside of the roll, needs to be pulled out and connected to the take-up means.

If the above prior art technique is applied in a printer with a configuration such as described above, the calculated consumed amount of the recording medium is based on the fed amount by the feeding means, and therefore is not corrected by the length of the recording medium pulled out during the preparation operation. As a result, the precision of the remaining amount of the recording medium stored in the storage means decreases.

SUMMARY

It is therefore an object of the present disclosure to provide a printer capable of storing the remaining amount (or consumed amount) of the recording medium with high precision.

In order to achieve the above-described object, according to the aspect of the present application, there is provided a printer comprising a feeder configured to feed a long recording medium along a feeding path, a printing head configured to perform printing on the recording medium fed by the feeder, a cutter that is configured to cut the recording medium on which printing was performed by the printing head, and is disposed on the feeding path on a downstream side than the printing head, a take-up portion that is configured to take up the recording medium on which printing was performed by the printing head, and is disposed on the feeding path on a downstream side than the cutter, a first memory configured to store a value related to a remaining amount or a consumed amount of the recording medium, a consumed amount calculating portion configured to calculate a first consumed amount of the recording medium based on a fed amount by the feeder, a first correcting portion configured to correct the value related to a remaining amount or a consumed amount of the recording medium stored in the first memory by means of the first consumed amount calculated by the consumed amount calculating portion, an operation signal input portion configured to input a predetermined operation signal, and a second correcting portion configured to correct the value related to a remaining amount or a consumed amount of the recording medium stored in the first memory by using a predetermined second consumed amount, triggered by input of the operation signal to the operation signal input portion.

As the preparation operation prior to the start of printing, the tip end of the recording medium on downstream side in the transport direction needs to be pulled out and connected to the take-up portion.

Nevertheless, the consumed amount (first consumed amount) of the recording medium calculated by consumed amount calculating portion is based on the fed amount by the feeder, and therefore is not corrected by the length of the recording medium pulled out during the preparation operation by first correcting portion.

Hence, in the present disclosure, second correcting portion is provided. With this arrangement, it is possible to store a value related to the remaining amount or consumed amount of the recording medium with high precision.

BRIEF DESCRIPTION OF THE DRAWINGS

FIG. 15 is a table used in a modification wherein the tape length correction value is determined in accordance with tape type information.

DETAILED DESCRIPTION OF THE PREFERRED EMBODIMENTS

Figure 1:
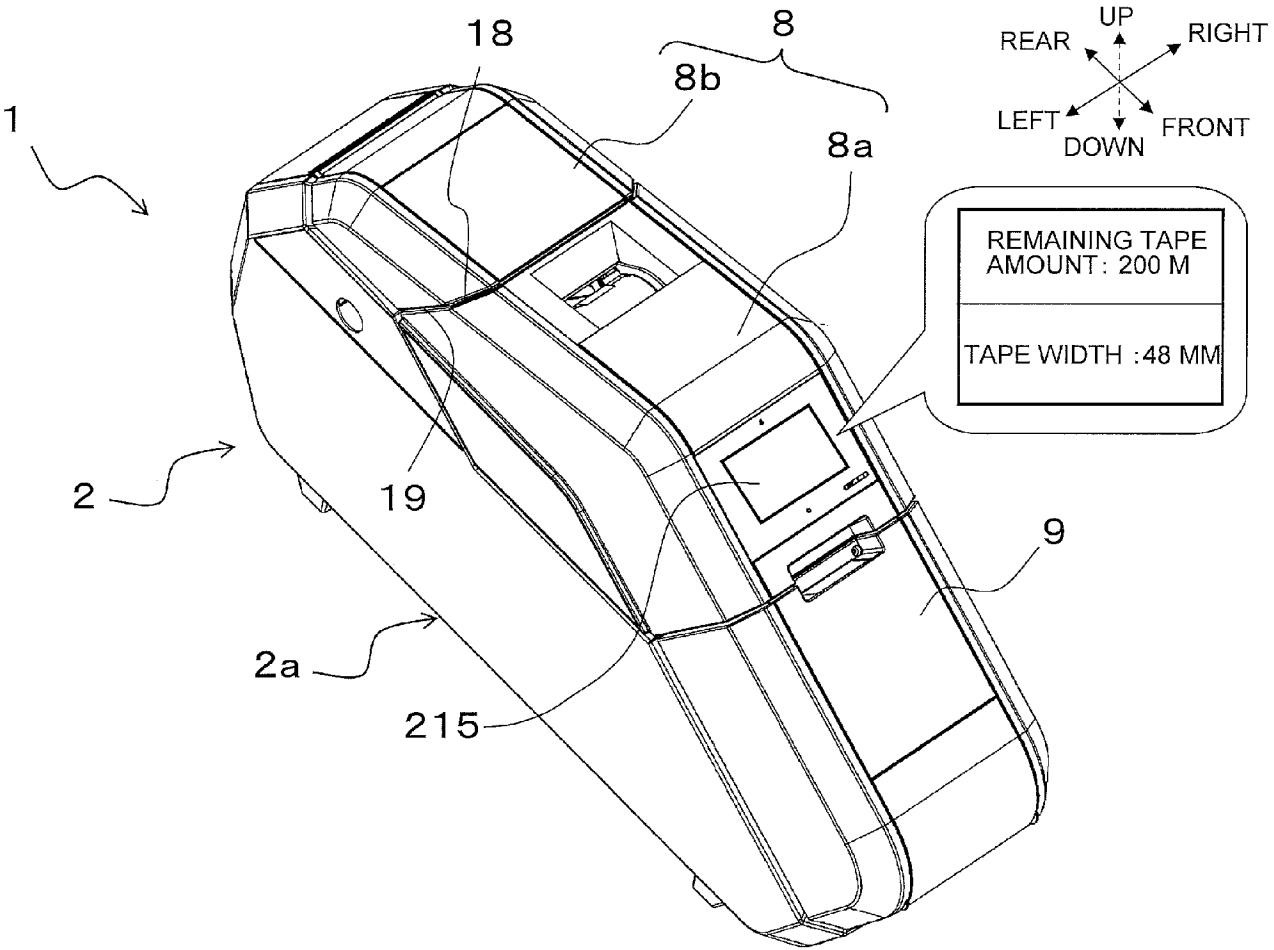
FIG. 1 is a perspective view showing the outer appearance of the tape printer related to an embodiment of the present disclosure.

The following describes one embodiment of the present disclosure with reference to accompanying drawings. Note that, in a case where "Front," "Rear," "Left," "Right," "Up," and "Down" are denoted in the drawings, the terms "Frontward (Front)," "Rearward (Rear)," "Leftward (Left)," "Rightward (Right)," "Upward (Up)," and "Downward (Down)" in the explanations of the description refer to the denoted directions.

General Configuration of Tape Printer

First, the general configuration of the tape printer related to this embodiment will be described with reference to FIGS. 1-4.

Housing

In FIGS. 1-4, a tape printer 1 in this embodiment comprises a housing 2 that constitutes the apparatus outer contour. The housing 2 comprises a housing main body 2*a*, a rearward-side opening/closing part 8, and a frontward-side opening/closing cover 9.

The housing main body 2*a* comprises a first storage part 3 disposed on the rearward side, and a second storage part 5 and a third storage part 4 disposed on the frontward side.

The rearward-side opening/closing part 8 is connected to an upper area of the rearward side of the housing main body 2*a* in an openable and closeable manner. This rearward-side opening/closing part 8 is capable of opening and closing the area above the first storage part 3 by pivoting. The rearward-side opening/closing part 8 comprises a first opening/closing cover 8*a* and a second opening/closing cover 8*b*.

The first opening/closing cover 8*a* is capable of opening and closing the area above the frontward side of the first storage part 3 by pivoting around a predetermined pivot axis K1 disposed in the upper area of the rearward side of the housing main body 2*a*. Specifically, the first opening/closing cover 8*a* is capable of pivoting from a closed position (the states in FIGS. 1 and 2) in which it covers the area above the frontward side of the first storage part 3, to an open position (the states in FIGS. 3 and 4) in which it exposes the area above the frontward side of the first storage part 3.

Figure 2:
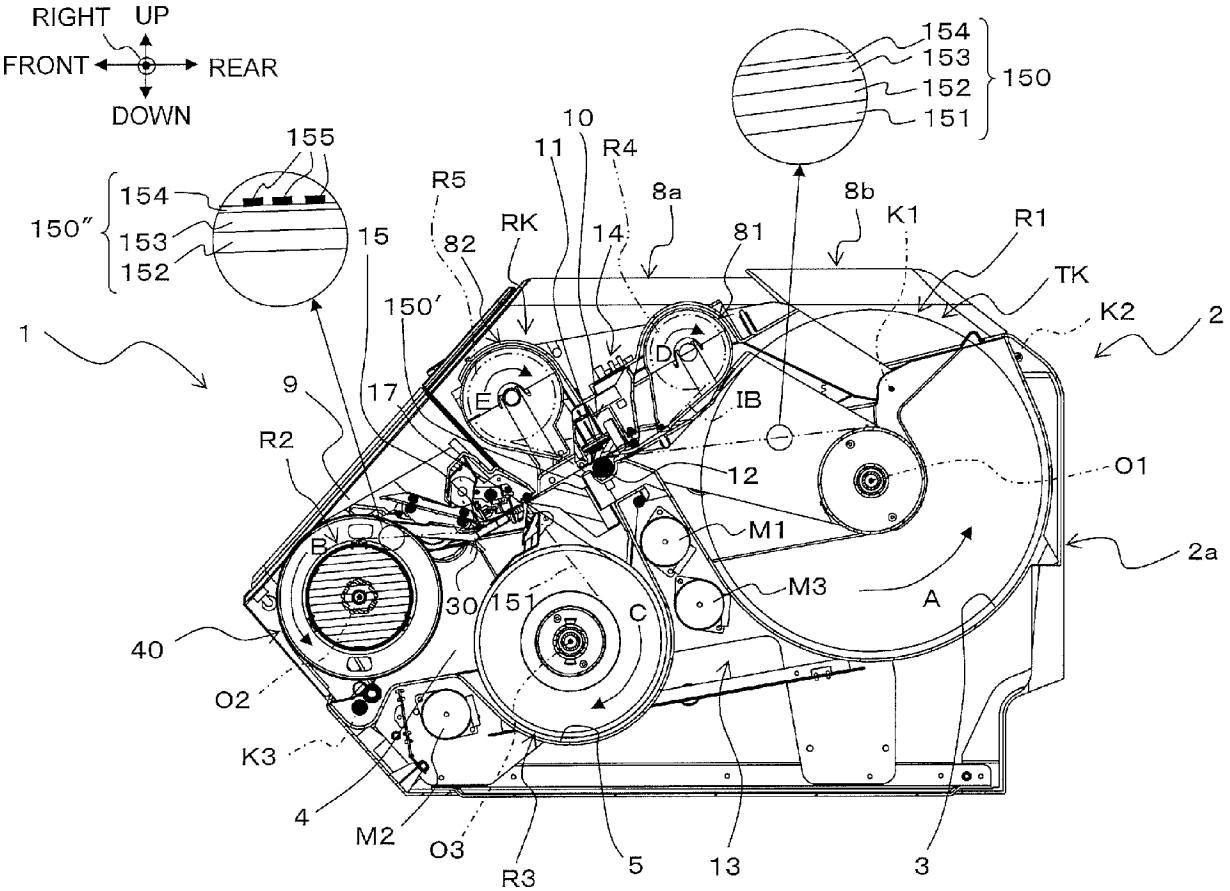
FIG. 2 is a side cross-sectional view showing the internal structure of the tape printer.
Figure 3:
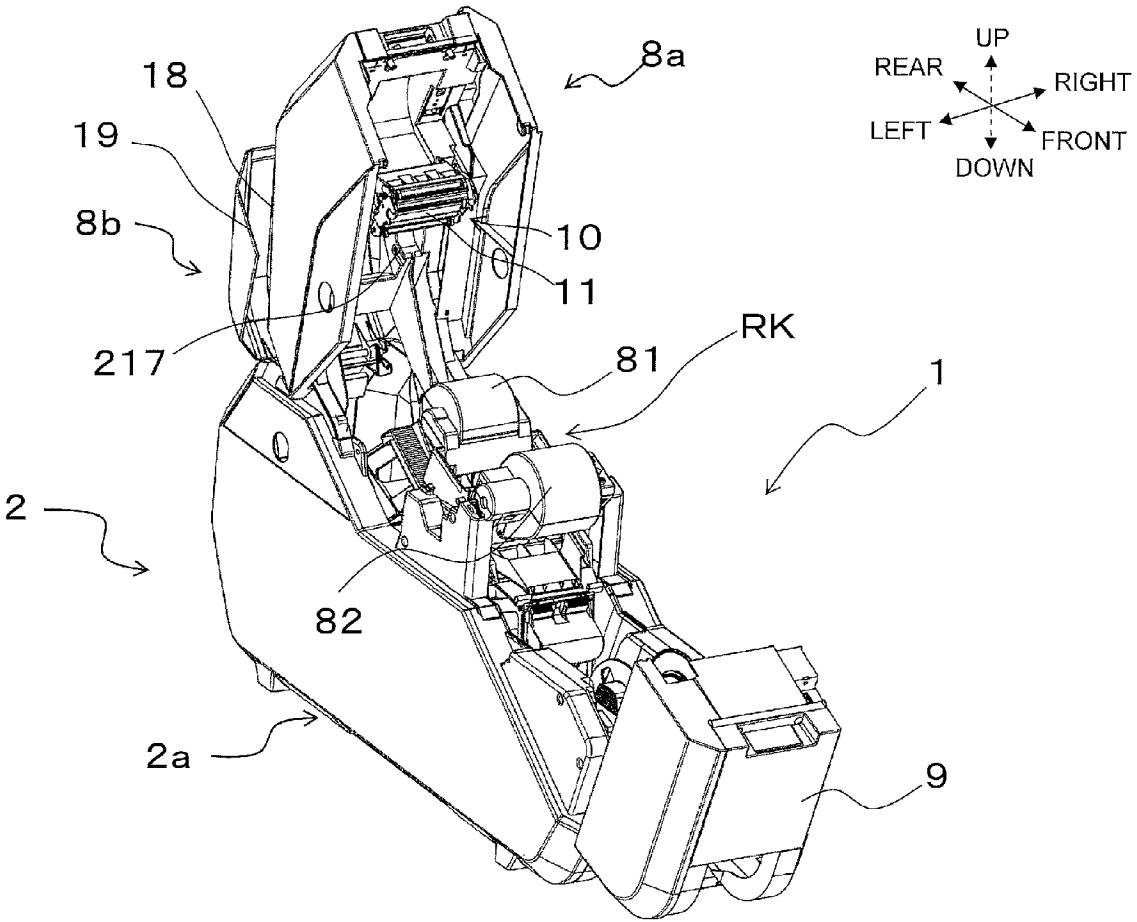
FIG. 3 is a perspective view showing the outer appearance of the tape printer with the first, second, and frontward-side opening/closing covers open.

A head holding body 10 is disposed in the interior of the first opening/closing cover 8*a* (refer to FIG. 3 as well). Then, the first opening/closing cover 8*a* pivots around the above described pivot axis K1, making it possible to move a printing head 11 included in the head holding body 10 relatively closer to or farther away from a feeding roller 12 disposed in the housing main body 2*a*. Specifically, the first opening/closing cover 8*a* is capable of pivoting from a closed position (the states in FIGS. 1 and 2) in which the printing head 11 is close to the feeding roller 12, to an open position (the states in FIGS. 3 and 4) in which the printing head 11 is far away from the feeding roller 12.

Note that a display part 215 (refer to step S215 in FIG. 13 described later) for displaying a remaining tape amount described later is disposed on the first opening/closing cover 8*a*.

The second opening/closing cover 8*b* is disposed further on the rearward side than the above described first opening/closing cover 8*a*, and is capable of opening and closing the area above the rearward side of the first storage part 3 separately from the opening and closing of the above described first opening/closing cover 8*a* by pivoting around a predetermined pivot axis K2 disposed on the upper end of the rearward side of the housing main body 2*a*. Specifically, the second opening/closing cover 8*b* is capable of pivoting from a closed position (the states in FIGS. 1 and 2) in which it covers the area above the rearward side of the first storage part 3, to an open position (the states in FIGS. 3 and 4) in which it exposes the area above the rearward side of the first storage part 3.

Then, the first opening/closing cover 8*a* and the second opening/closing cover 8*b* are configured so that, when each is closed, an outer circumference part 18 of the first opening/closing cover 8*a* and an edge part 19 of the second opening/closing cover 8*b* substantially contact each other and cover almost the entire area above the first storage part 3.

The frontward-side opening/closing cover 9 is connected to the upper area of the frontward side of the housing main body 2*a* in an openable and closeable manner. The frontward-side opening/closing cover 9 is capable of opening and closing the area above the third storage part 4 by pivoting around a predetermined pivot axis K3 disposed on the upper end of the frontward side of the housing main body 2*a*. Specifically, the frontward-side opening/closing cover 9 is capable of pivoting from a closed position (the states in FIGS. 1 and 2) in which it covers the area above the third storage part 4, to an open position (the states in FIGS. 3 and 4) in which it exposes the area above the third storage part 4.

Print-Receiving Tape Roll and Surrounding Area Thereof

Figure 4:
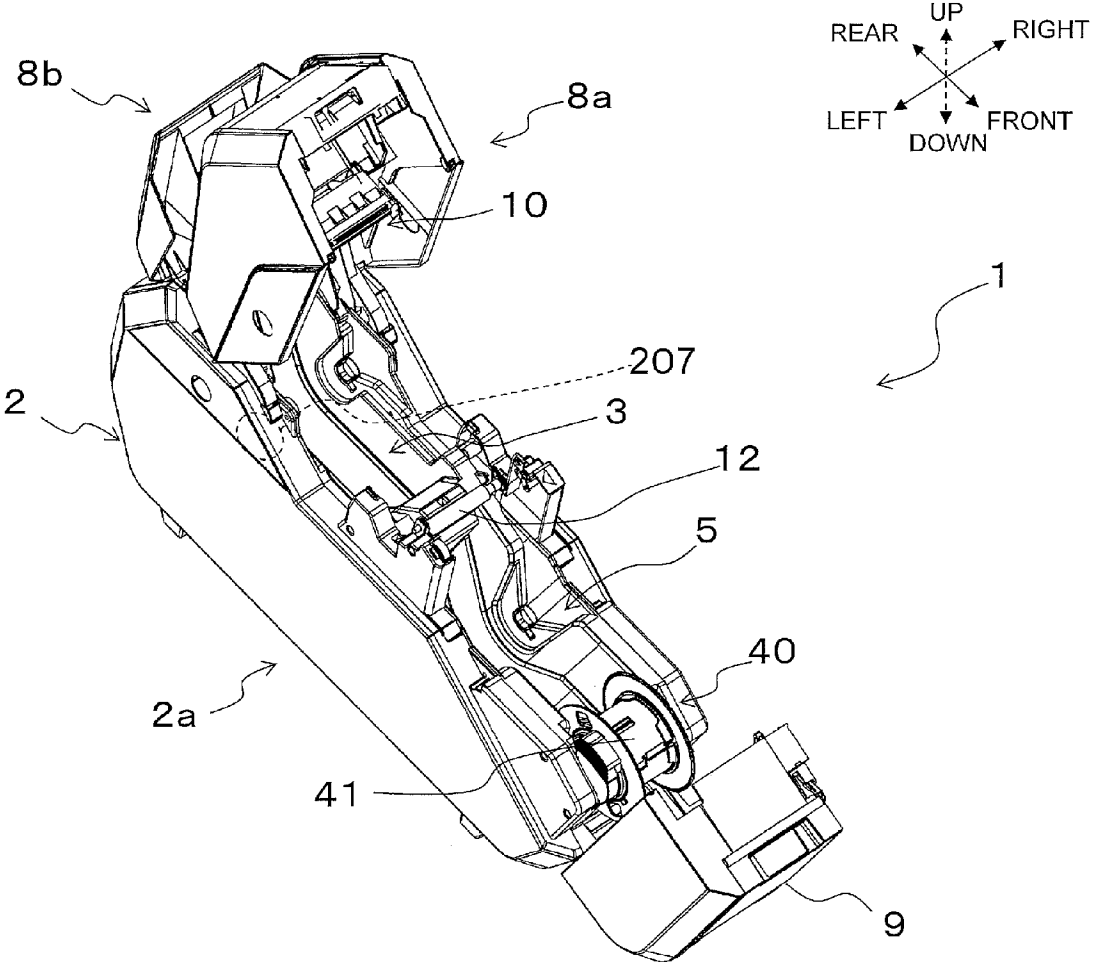
FIG. 4 is a perspective view showing the tape printer with the first, second, and frontward-side opening/closing covers open and the tape cartridge and ink ribbon cartridge removed.

At this time, as shown in FIGS. 2-4, a tape cartridge TK (refer to FIG. 2) is detachably mounted in a first predetermined position 13 below the frontward-side opening/closing cover 9 (when closed) of the housing main body 2*a*. This tape cartridge TK comprises a print-receiving tape roll R1 wound around and formed on an axis O1.

Figure 5:
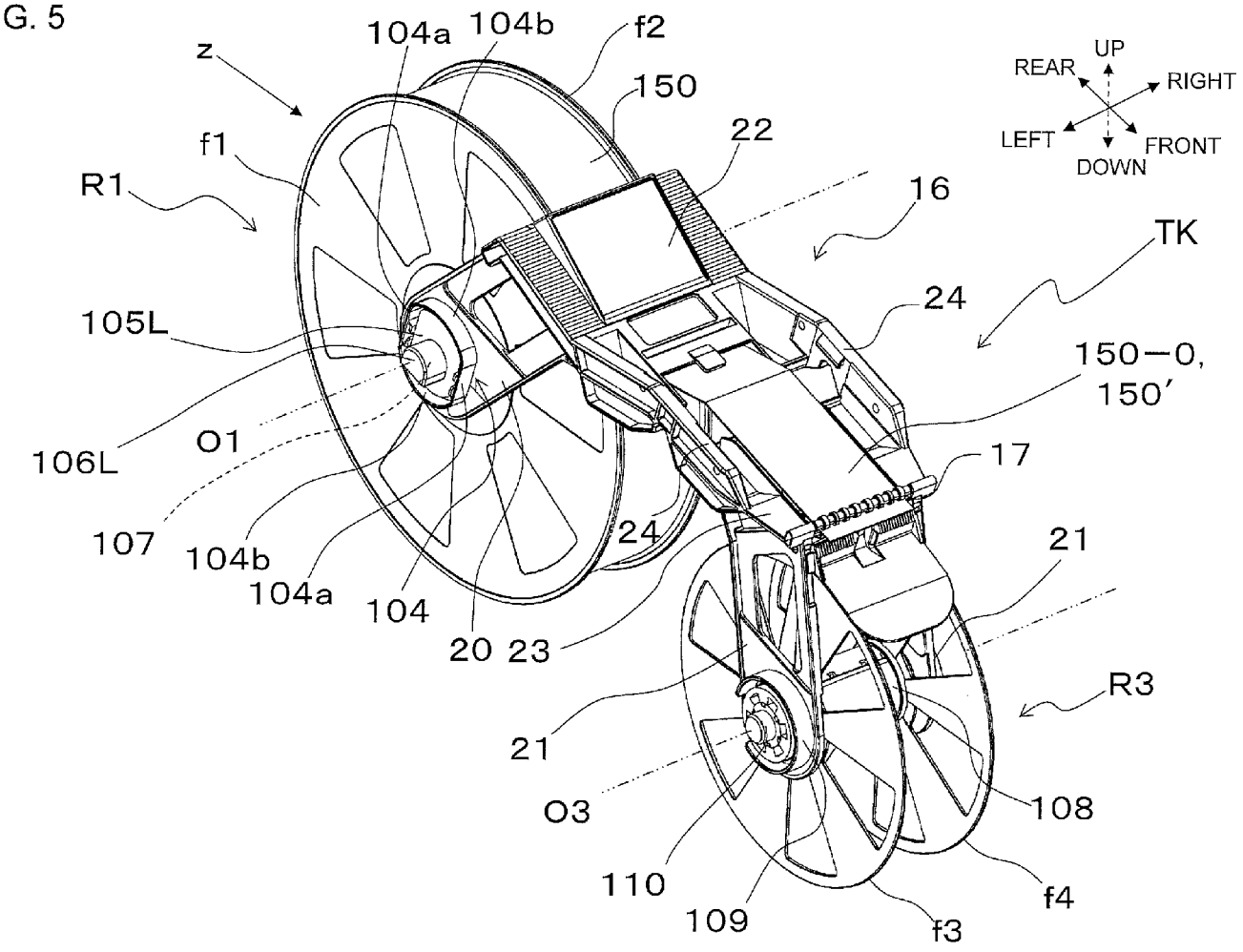
FIG. 5 is a perspective view showing the overall configuration of the tape cartridge.

That is, the tape cartridge TK comprises the print-receiving tape roll R1 and a connecting arm 16, as shown in FIG. 5. The connecting arm 16 comprises a left and right pair of first bracket parts 20, 20 disposed on the rearward side, and a left and right pair of second bracket parts 21, 21 disposed on the frontward side.

The first bracket parts 20, 20 are set so as to sandwich the above described print-receiving tape roll R1 from both the left and right sides along the axis O1 via a left and right pair of substantially circular roll flange parts f1, f2, holding the print-receiving tape roll R1 rotatably around the axis O1 with the tape cartridge TK mounted to the housing main body 2*a* (the detailed holding structure will be described later). These first bracket parts 20, 20 are connected by a first connecting part 22 that is extended substantially along the left-right direction on the upper end, avoiding interference with the outer diameter of the print-receiving tape roll R1.

The print-receiving tape roll R1 is rotatable when the tape cartridge TK is mounted in the interior of the housing main body 2*a*. The print-receiving tape roll R1 winds a long print-receiving tape 150 (comprising a print-receiving layer 154, a base layer 153, an adhesive layer 152, and a separation material layer 151 described later; refer to the enlarged view in FIG. 2) consumed by feed-out around the axis O1 in the left-right direction in advance.

The print-receiving tape roll R1 is received in the first storage part 3 from above by the mounting of the above described tape cartridge TK and stored with the axis O1 of the winding of the print-receiving tape 150 in the left-right direction. Then, the print-receiving tape roll R1, stored in the first storage part 3 (with the tape cartridge TK mounted), rotates in a predetermined rotating direction (a direction A in FIG. 2) inside the first storage part 3, thereby feeding out the print-receiving tape 150.

This embodiment illustrates a case where a print-receiving tape 150 comprising adhesive is used. That is, the print-receiving tape 150 is layered in the order of the print-receiving layer 154, the base layer 153, the adhesive layer 152, and the separation material layer 151, from one side in the thickness direction (upstream side in FIG. 2) toward the other side (downstream side in FIG. 2). The print-receiving layer 154 is a layer in which a desired print part 155 (refer to the enlarged partial view in FIG. 2) is formed by the heat transfer of ink from the above described printing head 11. The adhesive layer 152 is a layer for affixing the base layer 153 to a suitable adherent (not shown). The separation material layer 151 is a layer that covers the adhesive layer 152.

Feeding Roller and Printing Head

Returning to FIGS. 2-4, the above described feeding roller 12 is disposed on a middle upstream side of the first storage part 3 and the second storage part 5 of the housing main body 2*a*. The feeding roller 12 is driven by a feeding motor M1 disposed in the interior of the housing main body 2*a* via a gear mechanism (not shown), thereby feeding the print-receiving tape 150 fed out from the print-receiving tape roll R1 stored in the first storage part 3 in a tape posture in which the tape-width direction is in the left-right direction.

Further, the above described head holding part 10 disposed on the first opening/closing cover 8*a* comprises the above described printing head 11. The printing head 11, as described above, is capable of moving relatively closer to or farther away from the feeding roller 12 by the pivoting of the first opening/closing cover 8*a* around the pivot axis K1. That is, the printing head 11 moves closer to the feeding roller 12 when the first opening/closing cover 8*a* is closed, and farther away from the feeding roller 12 when the first opening/closing cover 8*a* is opened. This printing head 11 is disposed in a position of the head holding part 10 that faces the area above the feeding roller 12, with the first opening/closing cover 8*a* closed, sandwiching the print-receiving tape 150 fed by the feeding roller 12 in coordination with the feeding roller 12. Accordingly, when the first opening/closing cover 8*a* is closed, the printing head 11 and the feeding roller 12 are disposed facing each other in the up-down direction. Then, the printing head 11 forms desired print on the print-receiving layer 154 of the print-receiving tape 150 sandwiched between the printing head 11 and the feeding roller 12 using an ink ribbon IB of an ink ribbon cartridge RK described later, thereby forming a tape 150' with print.

Ink Ribbon Cartridge

As shown in FIG. 2 and FIG. 3, the ink ribbon cartridge RK is detachably mounted in a second predetermined position 14, which is below the first opening/closing cover 8*a* (when closed) and above the tape cartridge TK in the housing main body 2*a*. The ink ribbon cartridge RK comprises a rearward-side feed-out roll storage part 81 that stores a ribbon feed-out roll R4 that has wound the unused ink ribbon IB in a manner that enables feed-out, and a frontward-side take-up roll storage part 82 that stores a ribbon feed-out roll R5 that winds the used ink ribbon IB in a manner that enables take-up.

The ribbon feed-out roll R4 is rotatably supported inside the feed-out roll storage part 81, and rotates in a predetermined rotating direction (a direction D in FIG. 2) with the ink ribbon cartridge RK mounted, thereby feeding out the ink ribbon IB for print formation by the printing head 11.

The ribbon take-up roll R5 is rotatably supported inside the take-up roll storage part 82 and rotates in a predetermined rotating direction (a direction E in FIG. 2) with the ink ribbon cartridge RK mounted, thereby taking up the used ink ribbon IB after print formation.

That is, in FIG. 2, the ink ribbon IB fed out from the ribbon feed-out roll R4 is disposed further on the printing head 11 side of the print-receiving tape 150 sandwiched between the printing head 11 and the feeding roller 12, contacting the area below the printing head 11. Then, after the ink of the ink ribbon IB is transferred to the print-receiving layer 154 of the print-receiving tape 150 by the heat from the printing head 11 to execute print formation, the used ink ribbon IB is taken up on the ribbon take-up roll R5.

Separation Material Roll and Surrounding Area Thereof

As shown in FIG. 5, the connecting arm 16 of the tape cartridge TK comprises a peeling part 17 that includes a substantially horizontal slit shape, for example. This peeling part 17 is an area that peels the separation material layer 151 from the tape 150' with print fed out from the print-receiving tape roll R1 and fed to the frontward side. As shown in FIG. 2, the above described peeling part 17 peels the above described separation material layer 151 from the tape 150' with print on which print was formed as described above, thereby separating the separation material layer 151 and a tape 150" with print made of the other layers, i.e., the print-receiving layer 154, the base layer 153, and the adhesive layer 152.

The tape cartridge TK, as shown in FIG. 2 and FIG. 5, comprises a separation material roll R3 formed by winding the above described peeled separation material layer 151 around an axis O3. That is, the separation material roll R3 is received in the above described second storage part 5 from above by the mounting of the aforementioned tape cartridge TK and stored with the axis O3 for winding the separation material layer in the left-right direction. Then, the separation material roll R3, stored in the second storage part 5 (with the tape cartridge TK mounted), is driven by a separation sheet take-up motor M3 disposed on an interior substrate 2*b* of the housing main body 2*a* via a gear mechanism (not shown) and rotates in a predetermined rotating direction (a direction C in FIG. 2) inside the second storage part 5, thereby taking up the separation material layer 151.

Figure 6:
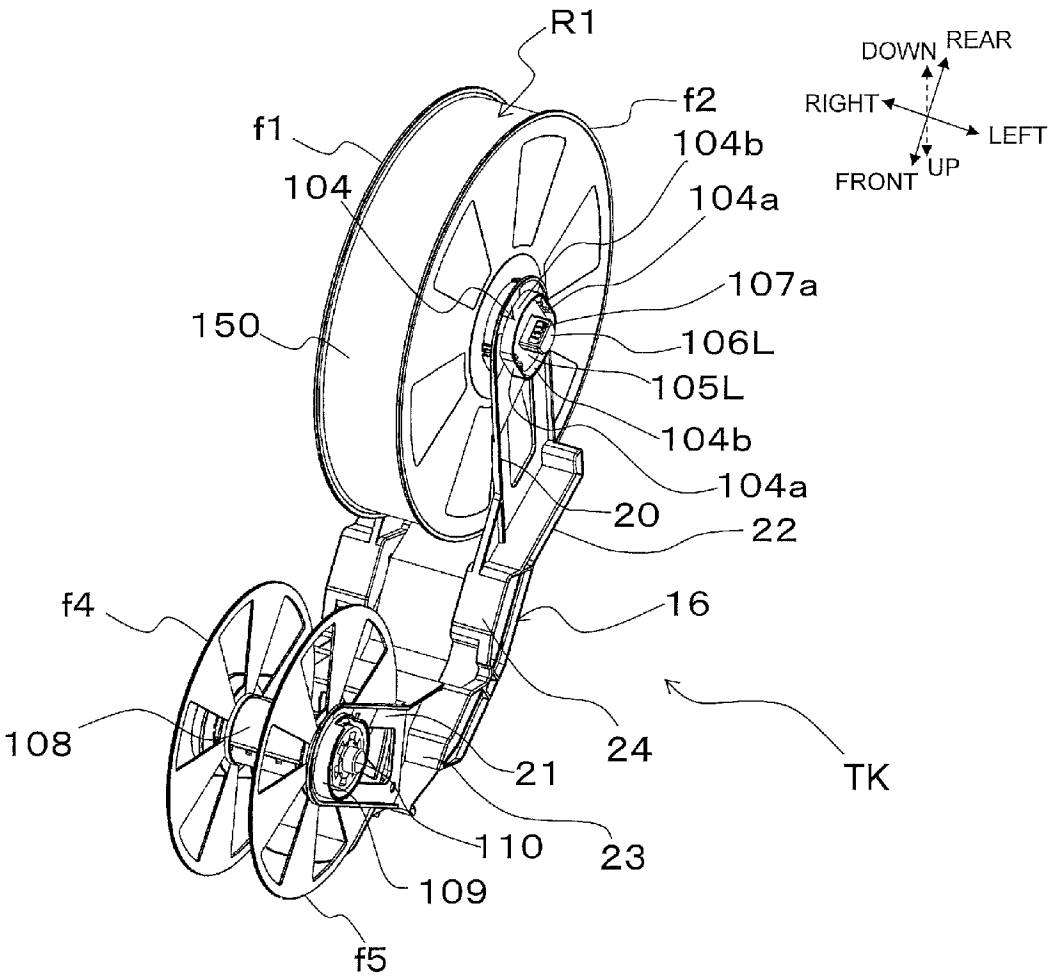
FIG. 6 is a perspective view showing the overall configuration of the tape cartridge from below.

At this time, as shown in FIG. 5 and FIG. 6, the above described second bracket parts 21, 21 of the tape cartridge TK are set so as to sandwich the above described separation material roll R3 from both the left and right sides along the axis O3 via a left and right pair of substantially circular roll flange parts f3, f4, holding the separation material roll R3 rotatably around the axis O3 with the tape cartridge TK mounted to the housing main body 2*a*. These second bracket parts 21, 21 are connected by a second connecting part 23 extended substantially along the left-right direction on the upper end. Then, the first bracket parts 20, 20 and the first connecting part 22 on the rearward side, and the second bracket parts 21, 21 and the second connecting part 23 on the frontward side are connected by a left and right pair of roll connecting beam parts 24, 24.

Note that FIG. 5 shows the state before the separation material layer 151 is wound around the axis O3 and the separation material roll R3 is formed (the case of the unused tape cartridge TK). That is, FIG. 5 shows substantially circular roll flange parts f3, f4 disposed so as to sandwich both width-direction sides of the separation material layer 151, and conveniently denotes the location where the separation material roll R3 is formed using the reference number "R3."

Tape Roll with Print and Surrounding Area Thereof

On the other hand, as shown in FIG. 2 and FIG. 4, a take-up mechanism 40 comprising a winding core 41 for sequentially winding the above described tape 150" with print is received in the above described third storage part 4 (in other words, on the tape feeding path further on the downstream side than a cutter mechanism 30 described later) from above. The take-up mechanism 40 is stored so that the above described winding core 41 is supported rotatably around an axis O2 of the winding of the tape 150" with print, with the axis O2 in the left-right direction. Then, stored in the third storage part 4, the winding core 41 is driven by an adhesive take-up motor M2 that is disposed in the interior of the housing main body 2*a* via a gear mechanism (not shown) and rotates in a predetermined rotating direction (a direction B in FIG. 2) inside the third storage part 4, sequentially taking up and layering the tape 150" with print on the outer circumference part of the winding core 41. With this arrangement, the tape 150" with print is sequentially wound around the outer circumference side of the winding core 41, forming a tape roll R2 with print.

Cutter Mechanism 30

Further, as shown in FIG. 2, the cutter mechanism 30 is disposed on the tape feeding path on the downstream side of the printing head 11 and the upstream side of the tape roll R2 with print.

The cutter mechanism 30, while not shown in detail, comprises a movable blade and a carriage that supports the movable blade and is capable of travelling in the tape-width direction (in other words, the left-right direction). Then, the carriage travels by the driving of a cutter motor (not shown) and the movable blade moves in the tape-width direction, cutting the above described tape 150" with print in the width direction.

Support Structure Details of Print-Receiving Tape Roll

Figure 7:
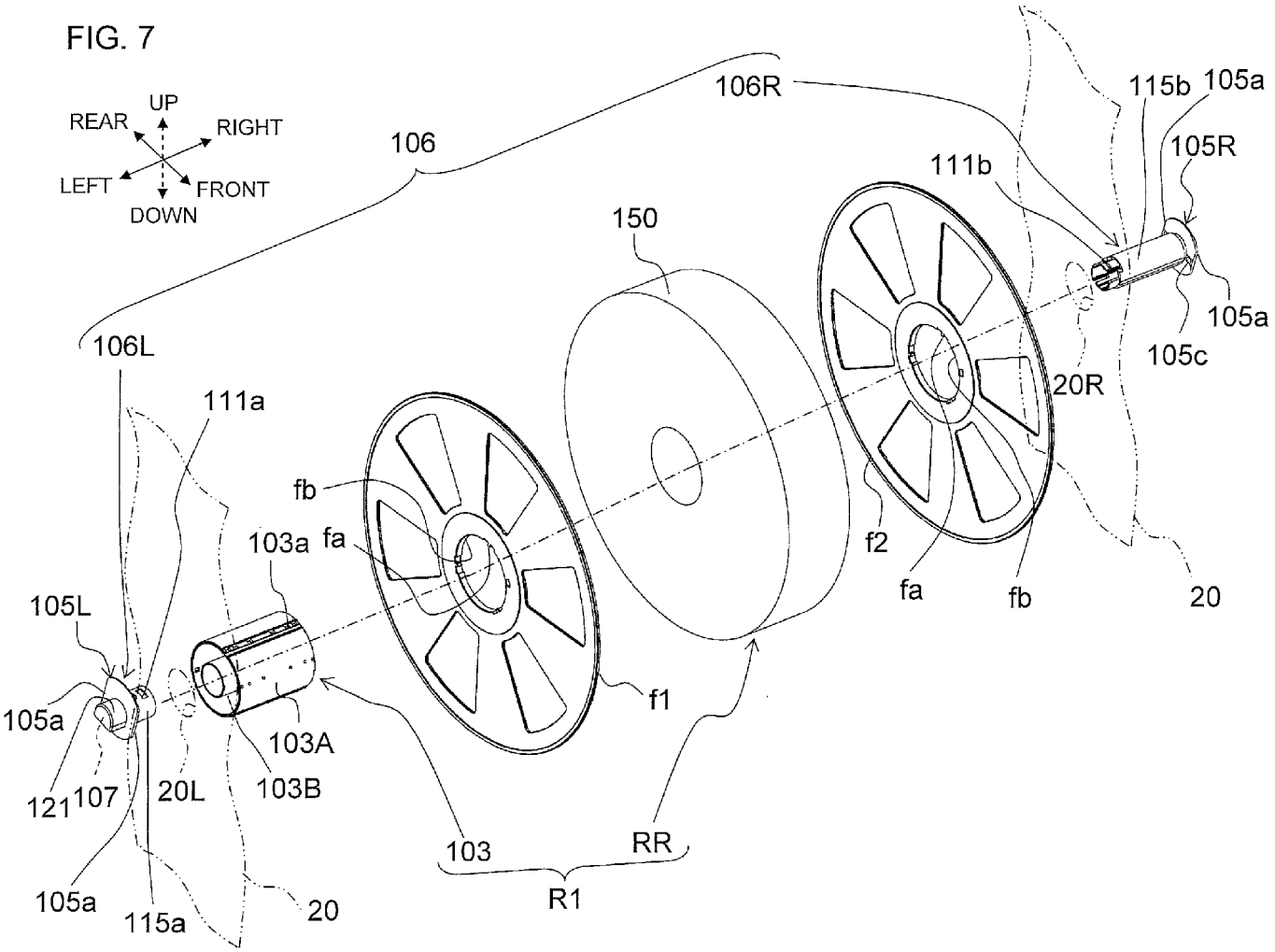
FIG. 7 is an exploded perspective view showing each component of the roll mechanism with a shaft incorporated in the tape cartridge.

As shown in FIG. 7, the print-receiving tape roll R1 comprises a winding core 103. That is, the above described print-receiving tape roll R1 is configured by winding the above described print-receiving tape 150 around the outer circumference of the winding core 103 in a manner that enables feed-out (by configuring a roll-shaped wound body RR).

The winding core 103 is rotatably supported by a fixed shaft member 106 wherein a left and right pair of a left fixed shaft part 106L and a right fixed shaft part 106R is directly connected to each other. That is, the winding core 103 comprises a double-tube structure with an outer cylinder 103A and an inner cylinder 103B. Then, a short cylinder part 115*a* positioned on the right-end side of the left fixed shaft part 106L is slidably inserted from the left side of the inner cylinder 103B. At this time, a through-hole 20L (roughly shown in FIG. 7) comprising an inner diameter that is larger than the outer diameter of the short cylinder part 115*a* is disposed on the above described first bracket part 20 on the left side. Then, the short cylinder part 115*a* is passed through the through-hole 20L and inserted into the inner cylinder 103B of the above described winding core 103 positioned on the opposite side (that is, the right side) via the first bracket part 20.

Similarly, a long cylinder part 115*b* positioned on the left-end side of the right fixed shaft part 106R is slidably inserted from the right side of the inner cylinder 103B. At this time, a through-hole 20R (roughly shown in FIG. 8) comprising an inner diameter that is larger than the outer diameter of the long cylinder part 115*b* is disposed on the above described first bracket part 20 on the right side. Then, the long cylinder part 115*b* is passed through the through-hole 20R and inserted into the inner cylinder 103B of the above described winding core 103 positioned on the opposite side (that is, the left side) via the first bracket part 20.

Subsequently, locking pieces 111*b* of the right fixed shaft part 106R are respectively engaged with locking holes 111*a* disposed in a plurality of circumferential direction locations on the left fixed shaft part 106L, thereby connecting and integrating the left and right fixed shaft parts 106L, 106R. With this arrangement, the winding core 103 establishes the fixed shaft member 106 made of the left and right fixed shaft parts 106L, 106R as a fixed center axis and is slidably rotatable around that axis, between the left and right pair of first bracket parts 20, 20.

At this time, a plurality of locking holes 103*a* is formed on the front surface of the outer cylinder 103A along the axial direction. On the other hand, a circular opening fb is disposed on the center side of the roll flange parts f1, f2. A locking protrusion fa is formed on the inner circumferential edge of a circular opening gb. Then, the respective locking protrusions fa of the roll flange parts f1, f2 are fit together with any of the locking holes 103*a* of the outer cylinder 103A, making it possible to fix the roll flange parts f1, f2 in positions corresponding to the width of the print-receiving tape 150 constituting the print-receiving tape roll R1.

As described above, the short cylinder part 115*a* and the long cylinder part 115*b* of the left and right fixed shaft parts 106L, 106R constituting the above described fixed shaft member 106 are inserted (via an allowance) into the through-holes 20L, 20R as described above. Nevertheless, these left and right fixed shaft parts 106L, 106R are non-rotatably engaged with the first bracket parts 20, 20 by positioning flange parts 105L, 105R respectively included therein.

That is, the respective first bracket parts 20 comprise a first guide part 104 that includes two up and down arc parts 104*b*, 104*b* and two front and rear linear parts 104*a*, 104*a*, and comprises a generally substantially oval (elliptical) shape, near the lower end, as shown in FIG. 5 and FIG. 6. On the other hand, the above described positioning flange parts 105L, 105R comprise a generally substantially elliptical shape (slightly smaller than the first guide part 104) that includes two front and rear linear outer edge parts 105*a*, 105*a* formed along the up-down direction (in other words, the gravity load direction).

Then, when the short cylinder part 115*a* is inserted into the through-hole 20L as described above, the positioning flange part 105L is stored in the above described first guide part 104 of the left first bracket part 20 while disposing the above described outer edge parts 105*a*, 105*a* substantially along the above described linear parts 104*a*, 104*a*. Similarly, when the long cylinder part 115*b* is inserted into the through-hole 20R, the positioning flange part 105R is stored in the above described first guide part 104 of the right first bracket part 20 while disposing the above described outer edge parts 105*a*, 105*a* substantially along the above described linear parts 104*a*, 104*a*. As a result, with the left and right positioning flange parts 105L, 105R stored in the first guide parts 104, 104, the left and right fixed shaft parts 106L, 106R are non-rotatably engaged with the left and right first bracket parts 20, 20.

With the above configuration, the roll flange parts f1, f2 and the winding core 103 are integrated, making rotation possible with respect to the fixed shaft member 106 to which the first bracket parts 20 are locked, between the left and right pair of first bracket parts 20, 20. As a result, the print-receiving tape roll R1 is rotatably supported around the above described axis O1 with respect to the first bracket parts 20, 20, making it possible to feed out the print-receiving tape 150 by rotation.

Memory Built into Shaft End of Left Fixed Shaft Part

According to this embodiment, a tape cartridge memory 107 is disposed on the left fixed shaft part 106L constituting the above described fixed shaft member 106. In the following, details on the functions will be described in order.

As shown in FIGS. 8A-8D and the above described FIG. 6, FIG. 7, and the like, the above described left fixed shaft part 106L comprises a shaft end housing part 121 on the opposite side (that is, the left side) of the above described short cylinder part 115*a*, with the positioning flange part 105L sandwiched therebetween. The shaft end housing part 121 comprises an outer shape that is substantially laterally D-shaped as viewed from the axial direction. The above described tape cartridge memory 107 is built in the interior of this shaft end housing part 121.

Figure 8A:
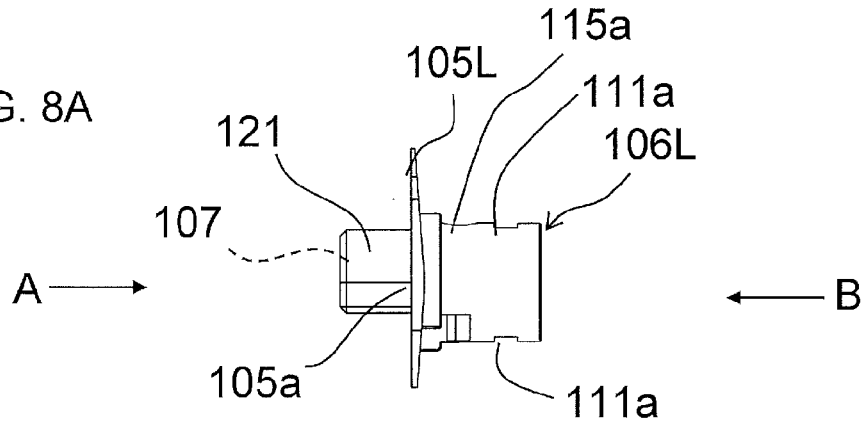
FIG. 8A is a side view showing the detailed structure of the left fixed shaft part.
Figure 8B:
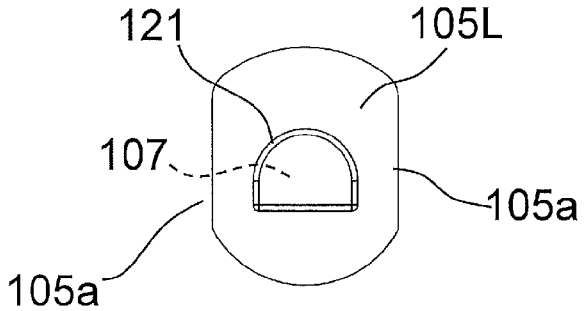
FIG. 8B is an arrow view showing the detailed structure of the left fixed shaft part from direction A in FIG. 9A
Figure 8C:
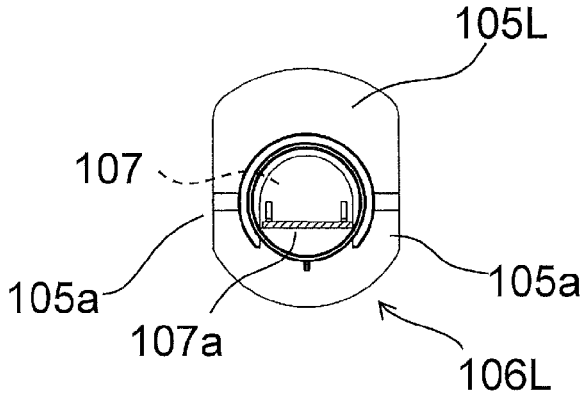
FIG. 8C is an arrow view showing the detailed structure of the left fixed shaft part from direction B in FIG. 9A.
Figure 8D:
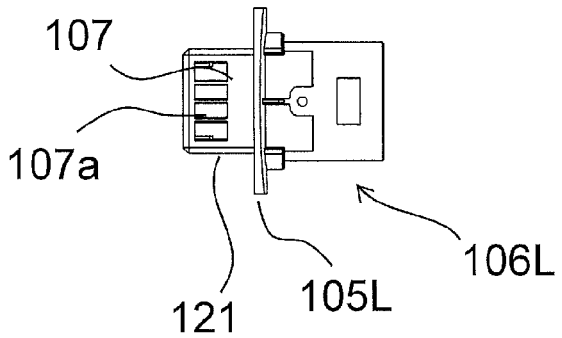
FIG. 8D is a bottom view showing the detailed structure of the left fixed shaft part.

Further, a terminal part 107*a* is disposed on the opening surface disposed on the downward linear section of the above described D-shape of the shaft end housing part 121 so as to be exposed on the front surface (refer to FIG. 8D and FIG. 6).

The terminal part 107*a* conducts current to the above described tape cartridge memory 107. Then, when the tape cartridge TK is mounted inside the housing main body 2*a* as described later, the terminal part 107*a* contacts from above and conducts current to an external terminal 207 (only the position of which is conceptually shown in FIG. 4) disposed on the inner circumference side area (details described later) of the left-side wall surface of the housing main body 2*a*. With this arrangement, it is possible to read and write information from the housing 2 side with the above described tape cartridge memory 107 connected to this terminal part 107*a*. Note that, according to this embodiment, the remaining tape amount of the print-receiving tape roll R1 of the tape cartridge TK is stored in the tape cartridge memory 107 as described later. Then, the reading of the stored remaining tape amount and the writing (including overwriting) of the new remaining tape amount are performed from the housing 2 side (details described later).

Detailed Structure Near Axis of Separation Material Roll

Returning to FIG. 5 and FIG. 6, on the other hand, the separation material roll R3 also has a support structure similar to that of the above described print-receiving tape roll R1, though not shown in detail. That is, the separation material roll R3 comprises a winding core 108, and the separation material layer 151 peeled as described above is taken up and wound around the outer circumference of the winding core 108 (the roll-shaped wound body is configured), thereby constructing the above described separation material roll R3.

The winding core 108 is rotatably supported by a fixed shaft member 110. The winding core 108 is a double-tube structure with an outer cylinder and an inner cylinder, similar to the above described winding core 103. At this time, a through-hole (not shown) comprising an inner diameter that is larger than the outer diameter of the above described outer cylinder is disposed on each of the left and right above described second bracket parts 21, 21. Then, a shaft main body part (a section equivalent to the above described short cylinder part 115*a* and long cylinder part 115*b*; not shown) of the fixed shaft member 110 is passed through the through-hole and slidably inserted into the inner cylinder of the above described winding core 108. With this arrangement, the winding core 108 establishes the above described fixed shaft member 110 as the fixed center axis and is slidably rotatable around that axis, between the left and right pair of second bracket parts 21, 21.

At this time, a plurality of locking holes is formed along the axial direction, similar to the locking holes 103*a* of the above described winding core 103, on the front surface of the outer cylinder of the above described winding core 108. On the other hand, locking protrusions (not shown) similar to the locking protrusions fa of the above described roll flange parts f1, f2 are formed on the center side of the roll flange parts f3, f4. Then, the respective above described locking protrusions of the roll flange parts f3, f4 are fit together with any of the above described locking holes of the outer cylinder of the above described winding core 108, making it possible to fix the roll flange parts f3, f4 to positions corresponding to the width of the separation material 151 constituting the separation material roll R3 (in other words, the width of the print-receiving tape 150).

With the above configuration, the roll flange parts f3, f4 and the winding core 108 are integrated, making rotation possible with respect to the fixed shaft member 110, between the left and right pair of second bracket parts 21, 21. With this arrangement, the separation material roll R3 is rotatably supported around the above described axis O3 with respect to the second bracket parts 21, 21. At this time, the fixed shaft member 110 is operably connected to the separation sheet take-up motor M3 via a gear mechanism (not shown), and is rotated by the driving force from the separation sheet take-up motor M3, making it possible to take up the above described separation material layer 151 peeled from the above described print-receiving tape 150.

Overview of Operation of Tape Printer

Next, an overview of the operation of the tape printer 1 with the above described configuration will be described.

That is, when the tape cartridge TK is mounted in the above described first predetermined position 13, the print-receiving tape roll R1 is stored in the first storage part 3 positioned on the rearward side of the housing main body 2*a*, and the axis O3 side that forms the separation material roll R3 is stored in the second storage part 5 positioned on the frontward side of the housing main body 2*a*. Further, the take-up mechanism 40 for forming the tape roll R2 with print is stored in the third storage part 4 positioned on the frontward side of the housing main body 2*a*.

In this state, the user attaches a tip end of a tape 150-1 (conveniently referred to in this manner; refer to FIG. 10A described later) made of the base layer 153 and the adhesive layer 152, generated by the peeling of the separation material layer 151 in advance from the print-receiving tape 150 (on which printing has not been started at this point in time), to the winding core 41 of the above described take-up mechanism 40. Then, when the feeding roller 12 is driven, the print-receiving tape 150 fed out by the rotation of the print-receiving tape roll R1 stored in the first storage part 3 is fed to the frontward side. Then, desired print is formed by the printing head 11 on the print-receiving layer 154 of the print-receiving tape 150 thus fed, thereby forming the tape 150' with print. When the tape 150' with print on which print was formed is further fed to the frontward side and fed to the peeling part 17, the separation material layer 151 is peeled at the peeling part 17, forming an adhesive tape 150" with print. The peeled separation material layer 151 is fed to the downstream side, introduced to and wound inside the second storage part 5, forming the separation material roll R3.

On the other hand, the adhesive tape 150" with print from which the separation material layer 151 has been peeled is further fed to the frontward side, introduced to the third storage part 4, and wound around the outer circumference side of the winding core 41 of the take-up mechanism 40 inside the third storage part 4, thereby forming the tape roll R2 with print. At this time, the cutter mechanism 30 disposed on the transport direction downstream side (that is, the frontward side) cuts the adhesive tape 150" with print. With this arrangement, the adhesive tape 150" with print wound around the tape roll R2 with print can be cut based on a timing preferred by the user and the tape roll R2 with print can be removed from the third storage part 4 after cutting. Note that the tape 150" with print (that forms the tape roll R2 with print) wound into a roll shape around the outer circumference part of the winding core 41 in this manner is suitably simply referred to as a "printed matter."

Note that, at this time, although not explained by illustration, a non-adhesive tape (one without the above described adhesive layer 152 and separation material layer 151) may be wound around the print-receiving tape roll R1. In this case as well, the print-receiving tape roll R1 which winds the non-adhesive tape is received in the first storage part 3 from above by the mounting of the tape cartridge TK and stored with the axis O1 of the winding of the non-adhesive tape in the left-right direction. Then, the print-receiving tape roll R1, stored in the first storage part 3 (with the tape cartridge TK mounted), rotates in a predetermined rotating direction (the direction A in FIG. 2) inside the first storage part 3, thereby feeding out the non-adhesive tape.

Further, at this time, a shoot 15 (refer to FIG. 2) for switching the feeding path of the above described non-adhesive tape (or the above described print-receiving tape 150) between a side toward the tape roll R2 with print and a side toward the discharging exit (not shown) may be disposed. That is, the non-adhesive tape after print formation (or the tape 150" with print) may be discharged as is from the discharging exit (not shown) disposed on the second opening/closing cover 8*b* side, for example, of the housing 2 to the outside of the housing 2 without being wound inside the third storage part 4 as described later by switching the tape path by a switch operation of the shoot 15 using a switch lever (not shown).

Control System

Figure 9:
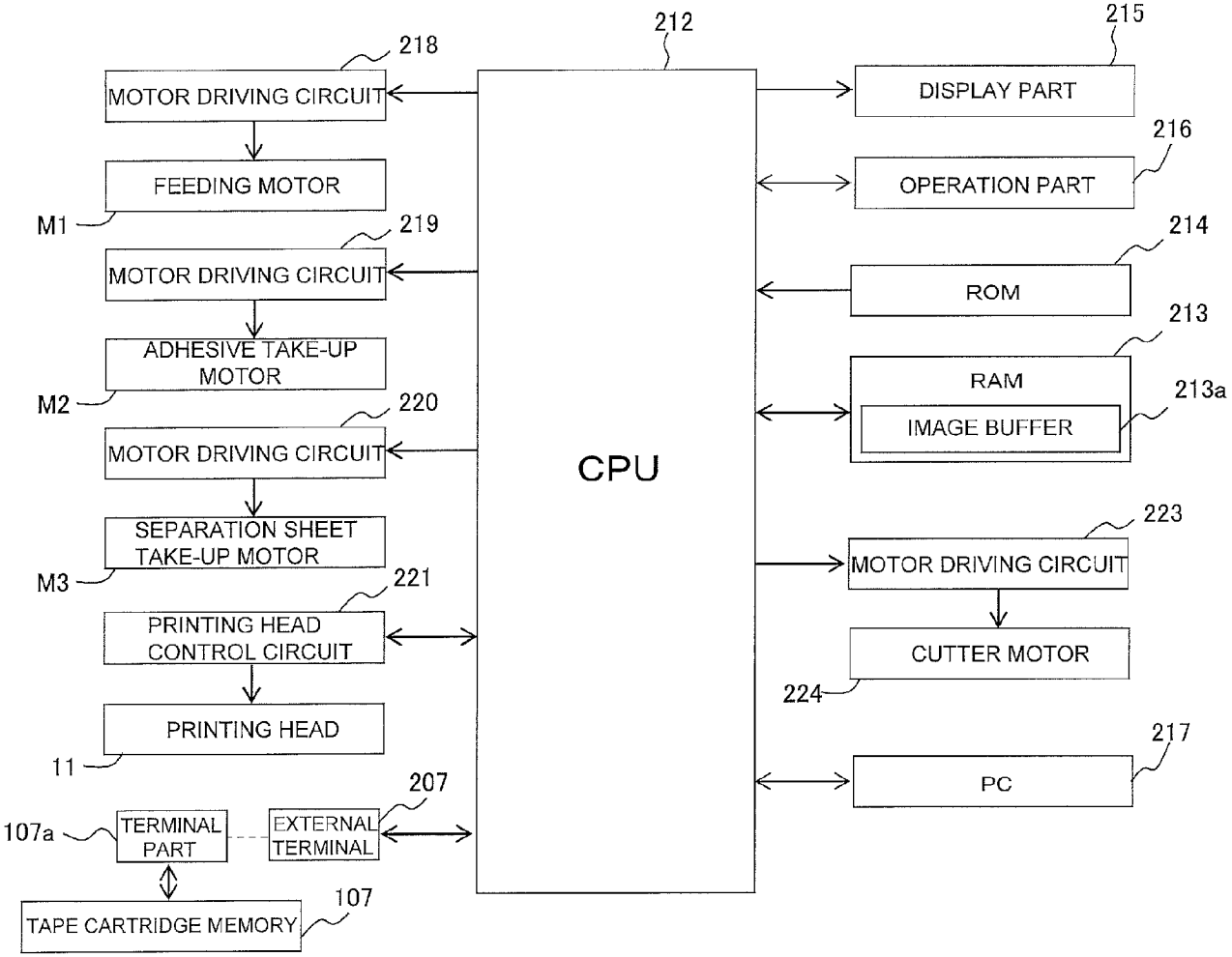
FIG. 9 is a function block diagram showing the configuration of the control system of the tape printer.

Next, the control system of the tape printer 1 will be described using FIG. 9. In FIG. 9, the tape printer 1 comprises a CPU 212 that constitutes a computing part that performs predetermined computations. The CPU 212 is connected to a RAM 213 and a ROM 214. The CPU 212 performs signal processing in accordance with a program stored in advance in the ROM 214 while utilizing a temporary storage function of the RAM 213, and controls the entire tape printer 1 accordingly.

Further, the CPU 212 is connected to a motor driving circuit 218 that controls the driving of the above described feeding motor M1 that drives the above described feeding roller 12, a motor driving circuit 219 that controls the driving of the above described adhesive take-up motor M2 that drives the winding core 41 of the above described take-up mechanism 40, a motor driving circuit 220 that controls the driving of the above described separation sheet take-up motor M3 that drives the above described separation material roll R3, a printing head control circuit 221 that controls the current conduction of the heating elements (not shown) of the above described printing head 11, a motor driving circuit 223 that controls the driving of a cutter motor 224 of the above described cutter mechanism 30, the display part 215 that performs suitable displays, and an operation part 216 that permits suitable operation input by the user. Further, while the CPU 212 is connected to a PC 217 serving as an external terminal in this example, the CPU 212 does not need to be connected in a case where the tape printer 1 operates alone (a so-called all-in-one type).

Further, according to this embodiment, the above described external terminal 207 is connected to the CPU 212. With this arrangement, as described above, when the external terminal 207 contacts and conducts current to the terminal part 107*a*, it is possible to perform information reading and writing with the above described tape cartridge memory 107 (perform remaining tape amount reading and writing according to this embodiment as described later).

The ROM 214 stores control programs for executing predetermined control processing (including programs that execute the flow processing in FIG. 13, FIG. 14, and the like described later). The RAM 213 comprises an image buffer 213*a* that expands print data (refer to step S203 described later) generated in correspondence with an operation of the above described operation part 216 (or the above described PC 217) by the user into dot pattern data for printing in a predetermined print area of the above described print-receiving layer 154, and stores the data, for example. The CPU 212 repeatedly prints one image corresponding to the above described dot pattern data stored in the image buffer 213*a* on the print-receiving tape 150 by the printing head 11 while feeding out the print-receiving tape 150 by the feeding roller 12, based on the above described control programs.

Behavior from Start of Take-Up to Completion

Next, the tape feeding and take-up behavior in this embodiment will be described using FIGS. 10-12.

Preparation Processing

Figure 10A:
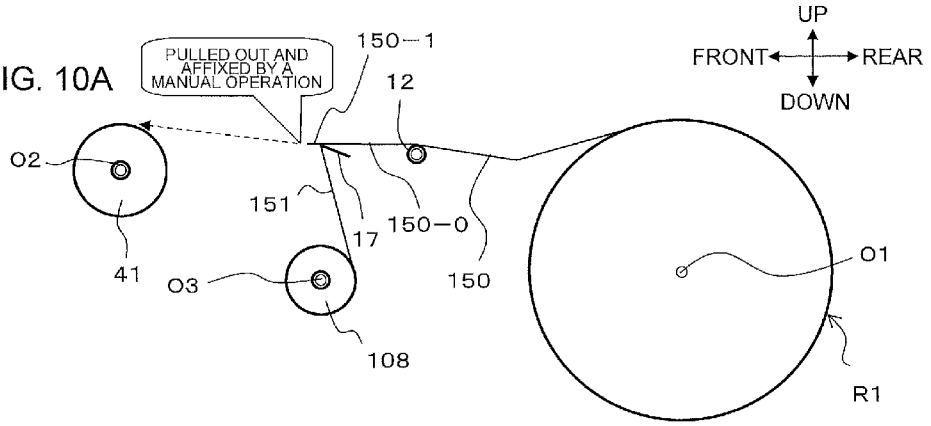
FIG. 10A is an explanatory view showing the tape feeding, take-up behavior, and the like in preparation processing.
Figure 10B:
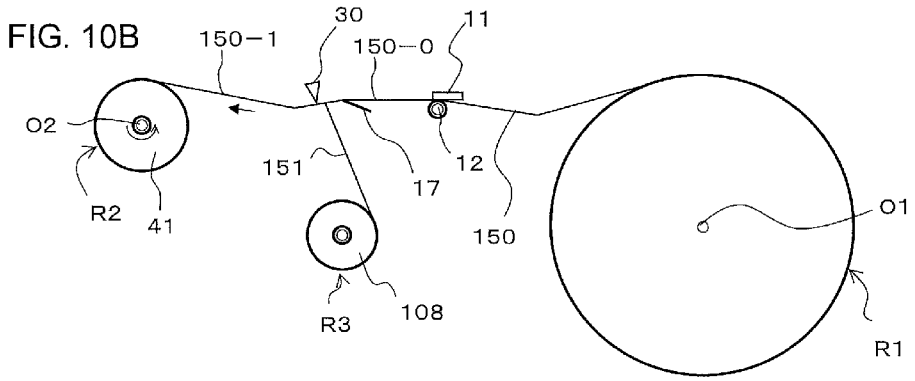
FIG. 10B is an explanatory view showing the tape feeding, take-up behavior, and the like in preparation processing.
Figure 10C:
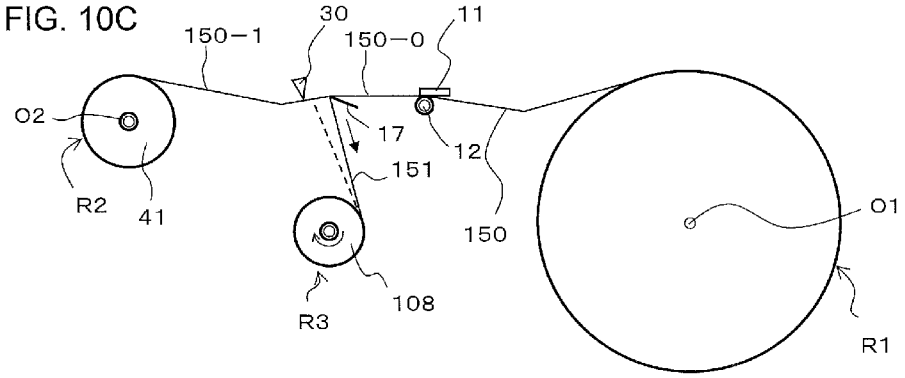
FIG. 10C is an explanatory view showing the tape feeding, take-up behavior, and the like in preparation processing.

According to this embodiment, before print is formed by the printing head 11 such as described above, predetermined preparation processing for removing the slack of the print-receiving tape 150 is performed. FIGS. 10A-10C schematically show this preparation processing step.

First, with the first opening/closing cover 8*a* and the second opening/closing cover 8*b* open, the user stores the tape cartridge TK in the housing main body 2*a* as described above. At this time, as shown in FIG. 10A, the tape cartridge TK is set so that, in an unused state, the separation material layer 151 peeled from the print-receiving tape 150 is connected to the winding core 108, while the tip end of the tape 150-1 (an area corresponding to the tape 150" with print after the start of print formation by the printing head 11 described later) made of the remaining base layer 153 and adhesive layer 152 protrudes further toward the transport direction downstream side than the peeling part 17. Note that, at this time, the print-receiving tape 150 positioned between the peeling part 17 and the feeding roller 12 is referred to as a tape 150-0 for convenience of explanation. This tape 150-0 is an area corresponding to a tape 150' with print after the start of print formation by the printing head 11 described later (refer to FIG. 5 described above as well).

Then, as shown by the broken line in FIG. 10A, the user secures the tip end of the tape 150-1 protruded as described above to the winding core 41 (refer to FIG. 4) of the take-up mechanism 40 for forming the tape roll R2 with print by a manual operation. With this arrangement, the above described printed matter is produced (in other words, the tape roll R2 with print is generated) by the winding of the tape 150-1 and the above described tape 150" with print with the rotation of the winding core 41 thereafter. On the other hand, the tip end of the separation material layer 151 peeled from the tape 150-0 is secured to the winding core 108 (refer to FIG. 5 and FIG. 6) for forming the separation material roll R3 as described above, and therefore the above described separation material roll R3 is formed by the winding of the separation material layer 151 with the rotation of the winding core 108 thereafter.

In this state, the first opening/closing cover 8*a* and the second opening/closing cover 8*b* are closed, and then the CPU 212 stops the feeding roller 12 for a predetermined amount of time and controls the feeding motor M1 and the adhesive take-up motor M2 so that only the above described winding core 41 is rotated in the take-up direction (refer to FIG. 10B). With this arrangement, the above described tape 150-1 from which the separation material layer 151 was peeled is pulled by the stopped feeding roller 12 and the winding core 41 that rotates in the take-up direction and, at the moment that the slack is removed, the rotation of the winding core 41 stops, causing tension to be applied to the tape 150-1. Note that, if rotation of the winding core 41 is detected at the moment that tension is to be applied to the tape 150-1 in this manner, the winding core 41 (in other words, the tape roll R2 with print) is regarded as rotating idly since the tip end of the tape 150-1 is not well secured to the winding core 41, and a defect is reported (refer to step S135 and step S190 described later).

Next, the CPU 212 stops the feeding roller 12 for a predetermined period of time and controls the feeding motor M1 and the separation sheet take-up motor M3 so that only the above described winding core 108 is rotated in the take-up direction (refer to FIG. 10C). With this arrangement, the separation material layer 151 peeled from the tape 150-0 is pulled by the stopped feeding roller 12 and the winding core 108 (in other words, the separation material roll R3) that rotates in the take-up direction and, at the moment that the slack is removed, the rotation of the winding core 108 stops, causing tension to be applied to the tape 150-0. Further, at this time, even if the separation point between the tape 150-0 and the separation material layer 151 has moved by the retraction of the tape 150-0 due to the rotation of the above described tape roll R2 with print only, the point can be returned to its original position (refer to the broken line in FIG. 10C). Note that, if rotation of the separation material roll R3 is detected at the moment that tension is to be applied to the separation material layer 151 in this manner, the separation material roll R3 is regarded as rotating idly since the tip end of the separation material layer 151 is not well secured to the above described winding core 108, and a defect is reported (refer to step S155 and step S198 described later).

Next, the CPU 212 controls the feeding motor M1, the adhesive take-up motor M2, and the separation sheet take-up motor M3 so as to rotate the feeding roller 12, the tape roll R2 with print, and the separation material roll R3 (without performing a print operation) for a predetermined period of time (not particularly shown). With this final verification operation, it is possible to verify in advance whether or not the series of operations including the feed-out and feeding of the print-receiving tape 150, the feeding of the tape 150-0, the feeding and take-up of the tape 150-1, the peeling and take-up of the separation material layer 151, and the like are normally performed (refer to step S165, step S170, and step S175 described later).

Printed Matter Production

Figure 11A:
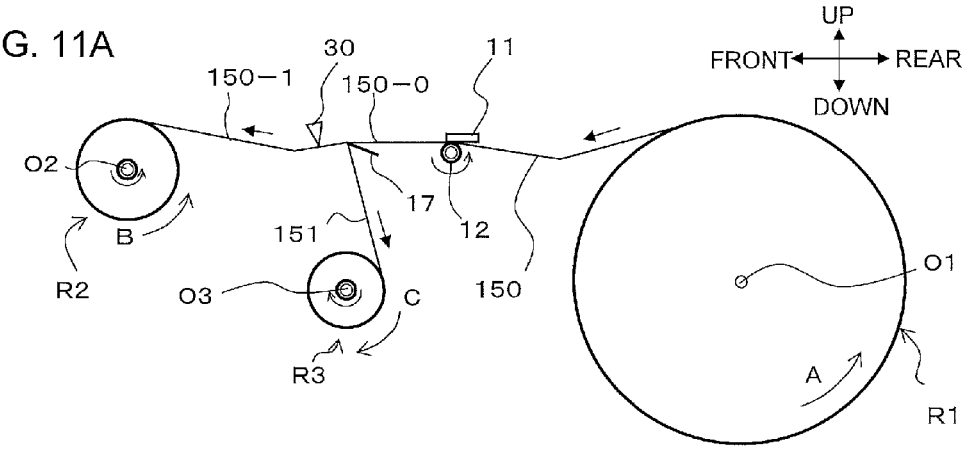
FIG. 11A is an explanatory view showing the tape feeding, print formation, tape take-up behavior, and the like during printed matter production.

After completion of the above described preparation processing, the above described printed matter resulting from the aforementioned print formation is produced. That is, as already described, from the state shown in FIG. 10C, the feed-out and feeding of the print-receiving tape 150, the generation and feeding of the tape 150' with print resulting from print formation on the print-receiving tape 150, the generation of the tape 150" with print resulting from the peeling of the separation material layer 151 from the tape 150' with print and the take-up of the peeled separation material layer 151, and the feeding and take-up of the tape 150" with print (hereinafter suitably collectively referred to as the "printed matter formation movement") are executed, as shown in FIG. 11A and further in FIG. 11B. The tape 150" with print resulting from the peeling of the separation material layer 151 from the tape 150' with print is sequentially taken up around the axis O2 by the take-up mechanism 40. The print-receiving tape 150 is fed by the feeding roller 12.

Figure 11B:
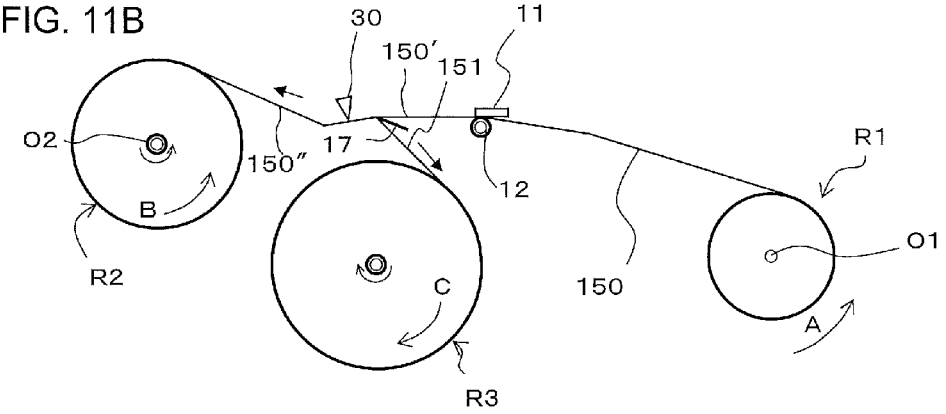
FIG. 11B is an explanatory view showing the tape feeding, print formation, tape take-up behavior, and the like during printed matter production.
Figure 12A:
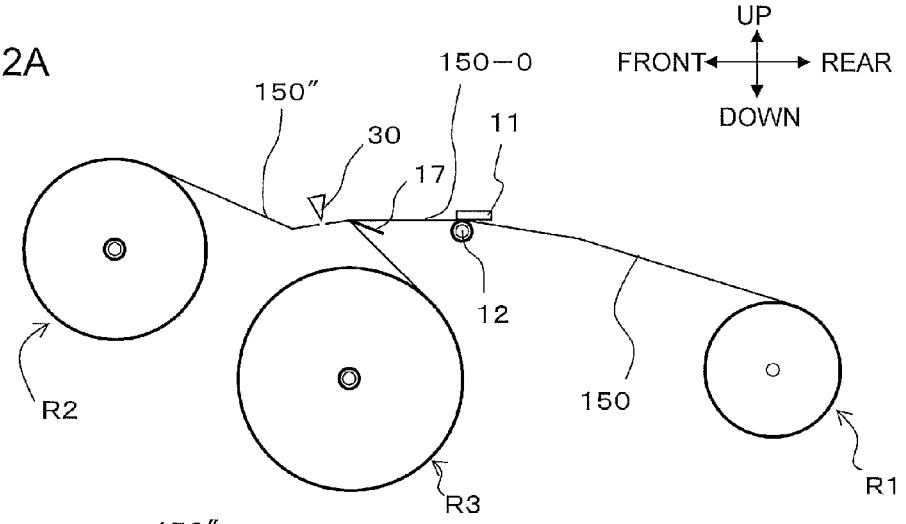
FIG. 12A is an explanatory view showing the tape feeding, cutting, take-up behavior, and the like during printed matter production.

Subsequently, the formation movement of the second roll R2 advances further from the state shown in FIG. 11B and, once the print-receiving tape 150, the tape 150' with print, and the tape 150" with print are in a specific transport direction position corresponding to the intention of the user, the rotation of the feeding roller 12, the tape roll R2 with print, and the separation material roll R3 is stopped as shown in FIG. 12A. As a result, the feed-out and feeding of the above described print-receiving tape 150, the feeding of the tape 150' with print, and the feeding and take-up of the tape 150" with print stop. Note that print formation is stopped in advance of the above described stop so that the area between the cutter mechanism 30 and the printing head 11 becomes an area of the above described tape 150-0, where print is not formed, in this stopped state. In this state, the cutter mechanism 30 cuts the tape 150" with print between the feeding roller 12 and the tape roll R2 with print (refer to FIG. 12A).

Subsequently, the adhesive take-up motor M2 is controlled so that tape roll R2 with print stops after rotation for a predetermined amount of time in the take-up direction (with the feeding roller 12 stopped as is). That is, after completion of the cutting of the tape 150" with print by the cutter mechanism 30, the tape roll R2 with print does not stop immediately, but rather after rotation for a predetermined amount of time. With this arrangement, the tape roll R2 with print is rotated a predetermined amount after cutting completion, and the end edge of the tape 150" with print generated by cutting is reliably taken up on the tape roll R2 with print, completing production of the above described printed matter (refer to FIG. 12B).

Essential Point of the Embodiment

In the above, the essential point of this embodiment is that the remaining tape amount of the print-receiving tape roll R1 consumed by the above described printed matter production is found and stored with precision. In the following, details on the technique will be described in order.

Holding, Reading, and Updating Remaining Tape Amount

As described above, in this embodiment, the tape cartridge memory 107 is disposed on the tape cartridge TK, and the remaining tape amount of the print-receiving tape roll R1 is written to and stored in the tape cartridge memory 107 and integrally held with the tape cartridge TK. As a result, even in a case where the tape cartridge TK is repeatedly attached and detached to and from the tape printer 1, the tape cartridge TK itself continually holds the remaining tape amount of the print-receiving tape roll R1, making it possible to reliably acquire the remaining tape amount by having the tape printer 1 read and acquire the held amount. Note that the remaining tape amount stored in the above described tape cartridge memory 107 may be the tape length itself or a value of a suitable state quantity corresponding to the tape length (refer to the number of pulses described later, for example).

When production of the above described printed matter is newly started and the tape cartridge TK is mounted, the remaining tape amount stored in the above described tape cartridge memory 107 as described above is acquired (refer to step S200 and step S205 of the flow shown in FIG. 13 described later). Then, the fed amount of the print-receiving tape 150 when the printed matter is produced as described above is detected (refer to step S216 of the flow shown in FIG. 13 described later). Then, the remaining tape amount is updated by subtracting the amount of the print-receiving tape 150 further consumed by printed matter production (calculated based on the above described fed amount; details described later) from the above described acquired remaining tape amount.

Cause of Error Occurrence in Remaining Tape Amount

Hence, as described above, according to this embodiment, if the tape cartridge TK is attached and detached to and from the tape printer 1, the user pulls out the tip end of the print-receiving tape 150 on the transport direction downstream side and connects the tip end to the winding core 41 of the take-up mechanism 40 in the preparation processing prior to the start of printing. In such a case, according to the above described technique, only the consumed amount of print-receiving tape 150 remains subtracted from the acquired remaining tape amount (without taking into consideration the amount pulled out by the above described manual operation), and therefore the length of the print-receiving tape 150 pulled out during the preparation operation is not incorporated into the consumed amount.

Processing Content Executed in Embodiment

Hence, in this embodiment, in response to the above, the remaining amount of the print-receiving tape 150 is corrected with high precision by using a correction value (fixed value) equivalent to the length of the print-receiving tape 150 pulled out during the above described preparation processing.

Figure 13:
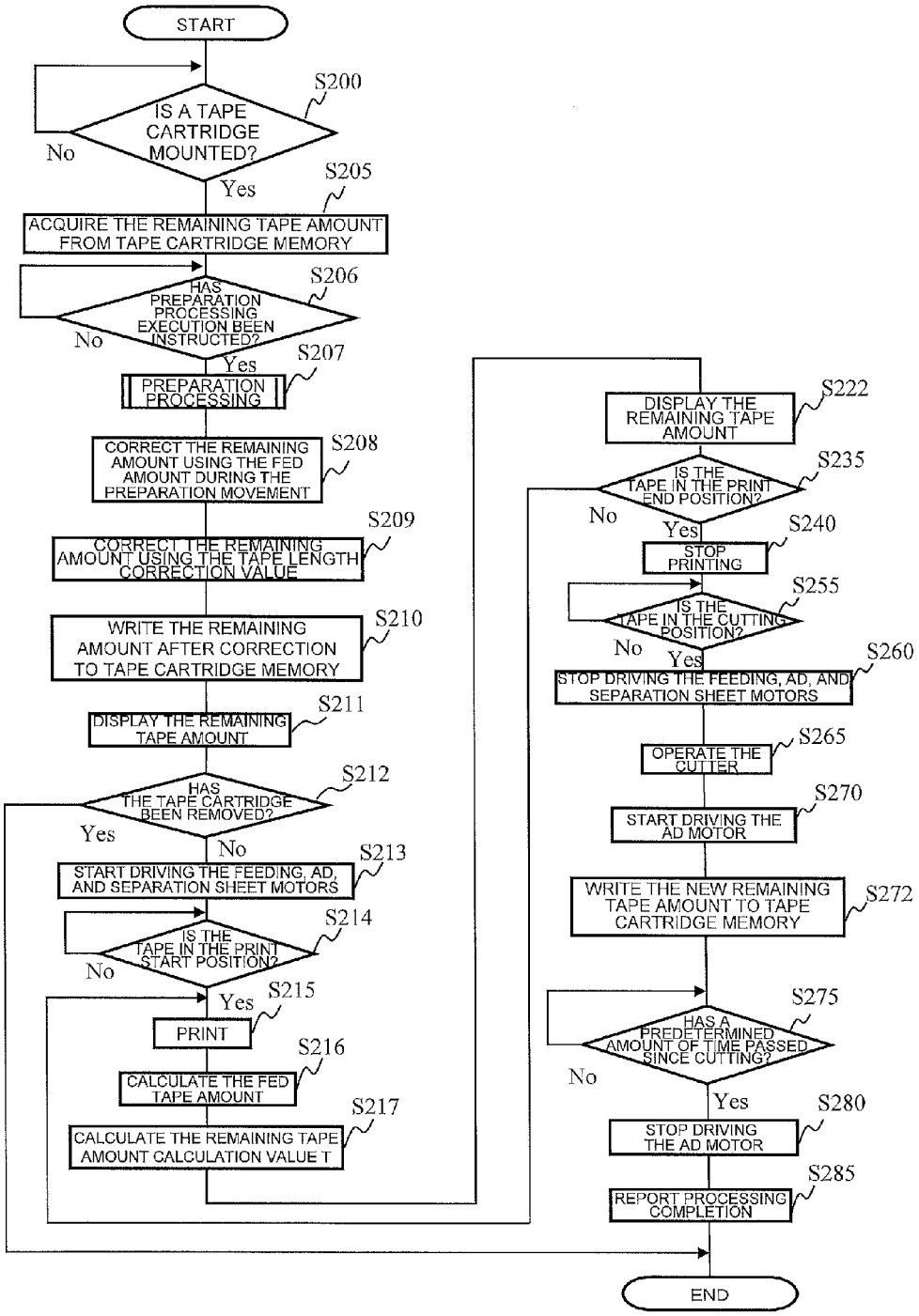
FIG. 13 is a flowchart showing the procedure of the control processing executed by the CPU of the tape printer.

The following describes the processing content executed by the above described CPU 212 to achieve the above described technique, using the flow in FIG. 13.

In FIG. 13, the flow is started by the user turning ON the power of the tape printer 1, for example ("START" position).

First, in step S200, the CPU 212 determines whether or not the tape cartridge TK and the ink ribbon cartridge RK have been respectively mounted to the first predetermined position 13 and the second predetermined position 14 of the housing main body 2*a*. For example, the installation of each of the cartridges TK, RK to the above described predetermined positions 13, 14 may be directly detected by a suitable contact type or non-contact type sensor, or the closed state of the above described first opening/closing cover 8*a* and second opening/closing cover 8*b* and the like may be detected by a suitable open/closed detection sensor or the like. Then, the above described determination is made based on the detection results thereof. Note that the tip end of the print-receiving tape 150 is pulled out by hand before the tape cartridge TK is mounted to the tape printer 1. If the cartridges TK, RK are not mounted to the above described predetermined positions 13, 14, the condition is not satisfied (S200: NO), and the flow loops back and enters a standby state until this condition is satisfied. If the cartridges TK, RK have been mounted, the condition is satisfied (S200: YES), and the flow proceeds to step S205.

In step S205, the CPU 212 acquires the remaining amount (the transport direction length, for example) of the print-receiving tape 150 of the print-receiving tape roll R1 stored in the above described tape cartridge memory 107 via the terminal part 107*a* and the external terminal 207, as described above.

In step S206, the CPU 212 determines whether or not an operation signal that instructs execution of the above described preparation processing has been input based on operation of the operation part 216 (or the above described PC 217) by the user. If the operation signal has not been input, the condition is not satisfied (S206: NO), and the flow loops back and enters a standby state until this condition is satisfied. If the operation signal has been input, the condition is satisfied (S206: YES), and the flow proceeds to step S207.

In step S207, the CPU 212 executes the above described preparation processing described using FIGS. 10A-10C. FIG. 14 shows the detailed content of this preparation processing.

Details of Preparation Processing

Figure 14:
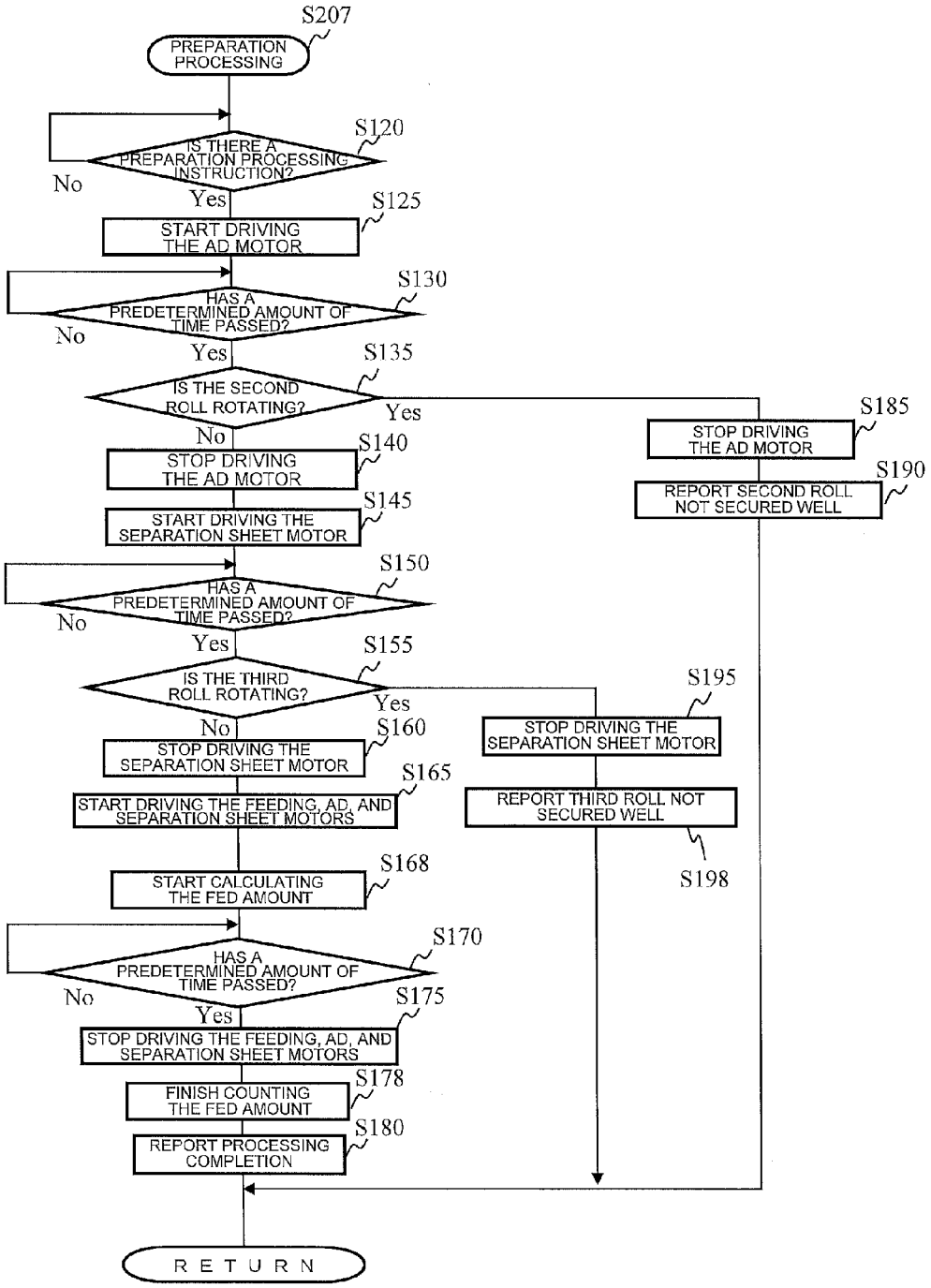
FIG. 14 is a flowchart showing the detailed procedure of the preparation processing in step S207.

In FIG. 14, first, in step S120, the CPU 212 determines whether or not (attachment of the aforementioned tape 150-1 to the above described winding core 41 has been completed and) an operation that instructs the start of preparation processing has been input by the user via the operation part 216 (or the above described PC 217). If the above described instruction operation has not been input, the condition of step S120 is not satisfied (step S120: NO), and the flow loops back and enters a standby state until the instruction operation is input. If the above described instruction operation has been input, the condition of step S120 is satisfied (step S120: YES), and the flow proceeds to step S125.

In step S125, the CPU 212 outputs a control signal to the motor driving circuit 219, and starts the driving of the adhesive take-up motor M2 (abbreviated "AD motor" in the figure; refer to the aforementioned FIG. 10B).

Subsequently, in step S130, the CPU 212 determines whether or not a predetermined amount of time has passed since the driving of the adhesive take-up motor M2 was started in the above described step S125. If the predetermined amount of time has not passed, the condition of step S130 is not satisfied (step S130: NO), and the flow loops back and enters a standby state until the predetermined amount of time passes. In this case, the predetermined amount of time that the flow is in a standby state may be about the amount of time it takes for the slack of the above described tapes 150-0, 150-1 from the feeding roller 12 to the tape roll R2 with print to be removed and appropriate tension to be applied (1 s maximum, for example). If the predetermined amount of time has passed, the condition of step S130 is satisfied (step S130: YES), and the flow proceeds to step S135.

In step S135, the CPU 212 determines whether or not the tape roll R2 with print is rotating at this moment based on a detection result of a suitable rotation detection sensor (such as an optical sensor, for example; not shown) disposed in accordance with the tape roll R2 with print. If the tape roll R2 with print is not rotating, the condition is not satisfied (S135: NO), and the flow proceeds to step S140.

In step S140, the CPU 212 outputs a control signal to the motor driving circuit 219 and stops the driving of the adhesive take-up motor M2.

Subsequently, in step S145, the CPU 212 outputs a control signal to the motor driving circuit 220, and starts the driving of the separation sheet take-up motor M3 (abbreviated as "separation sheet motor" in the figure; refer to the aforementioned FIG. 10C).

Then, in step S150, the CPU 212 determines whether or not a predetermined amount of time has passed since the start of the driving of the separation sheet take-up motor M3 in the above described step S145. If the predetermined amount of time has not passed, the condition of step S150 is not satisfied (step S150: NO), and the flow loops back and enters a standby state until the predetermined amount of time passes. In this case, the predetermined amount of time that the flow is in a standby state may be about the amount of time it takes for the slack of the separation material layer 151 from the feeding roller 12 to the separation material roll R3, including the pull-back of the aforementioned separation point, to be removed and appropriate tension to be applied. If the predetermined amount of time has passed, the condition of step S150 is satisfied (step S150: YES), and the flow proceeds to step S155.

In step S155, the CPU 212 determines whether or not the separation material roll R3 is rotating at this moment based on a detection result of a suitable rotation detection sensor (such as an optical sensor, for example; not shown) disposed in accordance with the separation material roll R3. If the separation material roll R3 is not rotating, the condition is not satisfied (S155: NO), and the flow proceeds to step S160.

In step S160, the CPU 212 outputs a control signal to the motor driving circuit 220 and stops the driving of the separation sheet take-up motor M3.

Subsequently, in step S165, the CPU 212 outputs a control signal to the motor driving circuits 218, 219, 220, and starts the driving of the feeding motor M1, the adhesive take-up motor M2, and the separation sheet take-up motor M3.

Subsequently, in step S168, the CPU 212 starts calculating the fed amount of the print-receiving tape 150 fed as described above, by a known technique. Specifically, in this example, the feeding motor M1 comprises a known pulse motor, and the CPU 212 calculates the above described fed amount by counting the number of pulses included in the control signal output from the above described motor driving circuit 218 to the feeding motor M1 during tape feeding. Note that, as the remaining tape amount stored in the aforementioned tape cartridge memory 107, the tape length may be converted to the number of pulses to the above described feeding motor M1 and the number of pulses may be stored as the value of the aforementioned state quantity.

Then, in step S170, the CPU 212 determines whether or not a predetermined amount of time has passed since the start of the driving of each motor in the above described step S165. If the predetermined amount of time has not passed, the condition of step S170 is not satisfied (step S170: NO), and the flow loops back and enters a standby state until the predetermined amount of time passes. In this case, the predetermined amount of time that the flow is in a standby state may be about the amount of time that it takes to adequately visually verify whether or not the series of operations including the feed-out and feeding of the print-receiving tape 150, the feeding of the tape 150-0, the feeding and take-up of the tape 150-1, the take-up of the separation material layer 151, and the like will be normally performed. If the predetermined amount of time has passed, the condition of step S170 is satisfied (step S170: YES), and the flow proceeds to step S175.

In step S175, the CPU 212 outputs a control signal to the motor driving circuits 218, 219, 220, and stops the driving of the feeding motor M1, the adhesive take-up motor M2, and the separation sheet take-up motor M3.

Subsequently, in step S178, the CPU 212 finishes calculation of the fed amount of the print-receiving tape 150 started in the above described step S168 (the calculation result is saved in a suitable location of the above described RAM 213 or the like).

Subsequently, in step S180, the CPU 212 reports that all operations have been normally performed and the preparation processing has normally ended by displaying so on the display part 215 (or the PC 217) or the like. This flow then terminates here.

On the one hand, if the CPU 212 determines that the tape roll R2 with print had been rotating in the above described step S135, the condition is satisfied (S135: YES), and the flow proceeds to step S185.

In step S185, the CPU 212 outputs a control signal to the motor driving circuit 219 and stops the driving of the adhesive take-up motor M2.

Subsequently, in step S190, the CPU 212 regards the tape roll R2 with print as rotating idly since the tip end of the tape 150-1 is not well secured to the above described winding core 41, and reports so by display on the display part 215 (or the PC 217). This flow then terminates here.

Further, on the other hand, if the CPU 212 determines that the separation material roll R3 had been rotating in the above described step S155, the condition is satisfied (S155: YES), and the flow proceeds to step S195.

In step S195, the CPU 212 outputs a control signal to the motor driving circuit 220 and stops the driving of the separation sheet take-up motor M3.

Subsequently, in step S198, the CPU 212 regards the separation material roll R3 as rotating idly since the tip end of the separation material layer 151 is not well secured to the winding core 108 for the third roll R3, and reports so by display on the display part 215. This flow then terminates here.

As described above, in step S207, without the printing head 11 performing printing on the print-receiving tape 150, the winding core of the above described take-up mechanism 40 takes up the tape 150-1 while the feeding roller 12 feeds the print-receiving tape 150. When this preparation processing ends, the flow proceeds to step S208 in FIG. 13.

Returning to FIG. 13, in step S208, the CPU 212 corrects the remaining amount of the print-receiving tape 150 acquired from the tape cartridge memory 107 in the above described step S205 by (subtracting in this example) the fed tape amount acquired in the above described step S178 (calculated based on the fed amount during the above described printing processing).

Subsequently, in step S209, the CPU 212 corrects the remaining amount of the print-receiving tape 150 (acquired from the tape cartridge memory 107) after correction in the above described step S208, by using (subtracting in this example) a predetermined tape length correction value. Note that, in the above described S208, the corrected remaining tape amount may be written to the tape cartridge memory 107, and the written remaining tape amount may be read again to perform the above described correction in this step S209. The tape length correction value at this time, according to this embodiment, is defined in a fixed manner. Specifically, for example, the value is set to approximately 20 cm, which is equivalent to the distance from the peeling part 17 of the tape cartridge TK to the winding core 41 of the take-up mechanism 40.

Then, in step S210, the CPU 212 stores (or overwrites and updates) the remaining tape amount after correction in the above described step S209 in the above described tape cartridge memory 107 via the above described external terminal 207 and the terminal part 107*a*.

Subsequently, in step S211, the CPU 212 outputs a display control signal to the display part 215 (or the above described PC 217), and displays the remaining tape amount determined in the above described step S208 and step S209 on the display part 215 (or the above described PC 217).

Then, in step S212, the CPU 212 determines whether or not the tape cartridge TK mounted to the above described first predetermined position 13 has been removed. The determination at this time may be made using the same technique as that in the above described step S200. If the tape cartridge TK has been removed, the condition is satisfied (S212: YES), and this flow is terminated. If the tape cartridge TK has not been removed, the condition is not satisfied (S212: NO), and the flow proceeds to step S213.

In step S213, the CPU 212 outputs a control signal to the motor driving circuits 218, 219, 220, starts the driving of the feeding motor M1, the adhesive take-up motor M2, and the separation sheet take-up motor M3, and starts the feeding of the above described print-receiving tape 150, the tape 150' with print, and the tape 150" with print (hereinafter, suitably simply referred to as "tape feeding") as well as the take-up of the above described tape 150" with print.

Subsequently, in step S214, the CPU 212 determines whether or not the above described tape feeding has arrived at the corresponding print start position by a known technique, based on the print data generated in advance in accordance with an input operation of the operation part 216 (or a separate external terminal connected to the CPU 212 in a manner that permits information transmission and reception) by the user. If the tape feeding has not arrived at the print start position, the condition is not satisfied (S214: NO), and the flow loops back and enters a standby state until this condition is satisfied. If the feeding has arrived at the print start position, the condition is satisfied (S214: YES), and the flow proceeds to step S215.

In step S215, the CPU 212 outputs a control signal to the printing head control circuit 221, conducts current to the heating elements of the printing head 11, and starts repeated print formation on the above described print-receiving tape 150 as one image corresponding to the above described print data.

Subsequently, in step S216, the CPU 212 calculates the fed amount of the above described tape feeding resulting from the feeding roller 12 started in the above described step S213. This calculation of the fed amount need only be performed by counting the number of pulses included in the control signal from the motor driving circuit 218 to the above described feeding motor M1, in the same manner as in the aforementioned step S168, or the like.

Then, the flow proceeds to step S217 where the CPU 212 calculates a latest remaining tape amount calculation value T by using (subtracting in this example) the fed amount calculated in the above described step S216 based on the remaining tape amount corrected in the above described step S209.

Subsequently, in step S222, the CPU 212 outputs a display control signal to the display part 215 (or the above described external terminal), and displays the remaining tape amount determined in the above described step S216 and step S217 on the display part 215 (or the above described PC 217). The example shown in the aforementioned FIG. 1 shows a display example at this time, and the remaining tape amount "200 m" of the print-receiving tape 150 is displayed along with the tape width "48 mm" of the print-receiving tape. Subsequently, the flow proceeds to step S235.

In step S235, the CPU 212 determines whether or not the above described tape feeding started in step S213 has arrived where the printing head 11 faces the print end position by a known technique, based on the above described print data. If the tape feeding has not arrived at the print end position, the condition is not satisfied (S235: NO), the flow returns to the step S215, and the same procedure is repeated. With this arrangement, the aforementioned repeated print formation is continued. On the other hand, if the tape feeding has arrived at the print end position, the condition is satisfied (S235: YES), and the flow proceeds to step S240.

In step S240, the CPU 212 outputs a control signal to the printing head control circuit 221, and stops conducting current to the heating elements of the printing head 11 and print formation (formation of the print part 155) on the above described print-receiving tape 150. With this arrangement, a blank state where the print part 155 does not exist (the aforementioned tape 150-0) is thereafter formed on the adhesive tape 150' with print. Subsequently, the flow proceeds to step S255.

In step S255, the CPU 212 determines whether or not the above described tape feeding has arrived at the cutting position by the above described cutter mechanism 30 (in other words, a cutting position such as where the total length along the transport direction of the tape 150" with print wound as the second roll R2 by the take-up mechanism 40 becomes the length intended by the user), in accordance with a tape length desired by the user, set in advance via the operation part 216 or the above described PC 217. If the feeding has not arrived at the cutting position, the condition is not satisfied (S255: NO), and the flow loops back and enters a standby state. If the feeding has arrived at the cutting position, the condition is satisfied (S255: YES), and the flow proceeds to step S260.

In step S260, the CPU 212 outputs a control signal to the motor driving circuits 218, 219, 220, and stops the driving of the feeding motor M1, the adhesive take-up motor M2, and the separation sheet take-up motor M3. With this arrangement, the feeding of the above described print-receiving tape 150, the tape 150' with print, and the tape 150" with print (including the above described tape 150-0 as well) is stopped. Note that the remaining tape amount for which calculation was started in the above described step S217 is determined by this stopping of feeding.

Subsequently, in step S265, the CPU 212 outputs a control signal to a cutter driving circuit 223, drives the above described cutter motor 224, and cuts the tape 150" with print by the operation of the above described cutter mechanism 30 (refer to the aforementioned FIG. 12A).

Figure 12B:
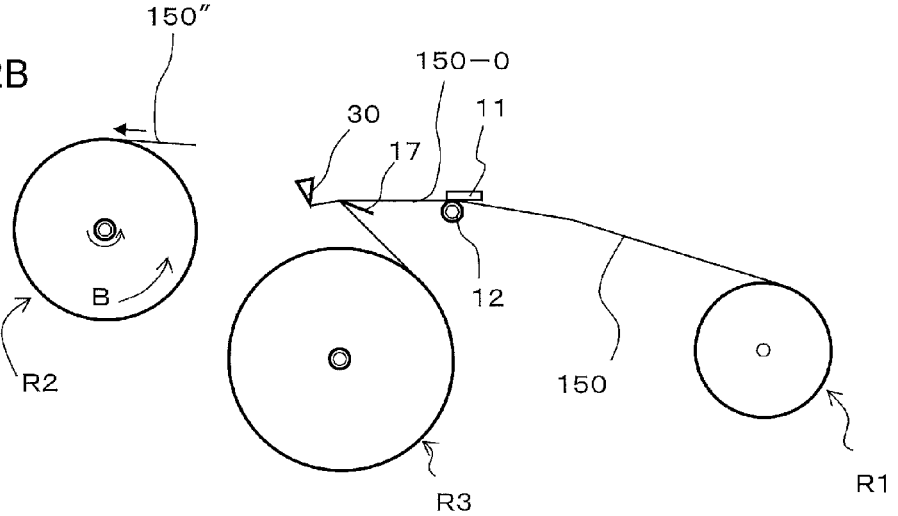
FIG. 12B is an explanatory view showing the tape feeding, cutting, take-up behavior, and the like during printed matter production.

Then, the flow proceeds to step S270, and the CPU 212 outputs a control signal to the motor driving circuit 219, starts the driving of the adhesive take-up motor M2 and the take-up of the end edge of the tape 150" with print (refer to FIG. 12B).

Subsequently, in step S272, the CPU 212 writes the remaining tape amount determined by the stopping of feeding in the above described step S260 after the start of calculation in the above described step S217 to the above described tape cartridge memory 107 via the external terminal 207 and the terminal part 107*a*, and overwrites and updates the held remaining tape amount.

Subsequently, in step S275, the CPU 212 determines whether or not a predetermined amount of time has passed since the cutting operation of the cutter mechanism 30 in the above described step S265. If the predetermined amount of time has not passed, the condition is not satisfied (S275: NO), and the flow loops back and enters a standby state. This predetermined amount of time only needs to be a sufficient amount of time for taking up the above described end edge of the tape 150" with print on the above described winding core 41 of the take-up mechanism 40. If the above described predetermined amount of time has passed, this condition is satisfied (S275: YES), and the flow proceeds to step S280.

In step S280, the CPU 212 outputs a control signal to the motor driving circuit 219 and stops the driving of the adhesive take-up motor M2. With this arrangement, it is possible to reliably take up the tape 150" with print generated by the above described cutting onto the tape roll R2 with print. As a result, the tape 150" with print wound around the outer circumference side of the winding core 41 to constitute the tape roll R2 with print, and the adhesive tape 150" with print following the state of connection to the print-receiving tape 150 are divided and separated.

Subsequently, in step S285, the CPU 212 reports that all of the above described processing has been normally performed and completed by displaying so on the above described display part 215 (or the above described PC 217). This flow then terminates here.

Advantages of this Embodiment

As described above, in the tape printer 1 related to this embodiment, triggered by the input of the operation signal that instructs preparation processing execution by the user in the above described step S206, the remaining amount of the print-receiving tape 150 stored in the tape cartridge memory 107 is not only corrected in step S208 and step S217 based on the fed tape amount, but is also corrected using the above described tape length correction value defined in advance, and then stored in the tape cartridge memory 107. With this arrangement, it is possible to store the remaining amount of print-receiving tape 150 with high precision.

Modifications

Note that the present disclosure is not limited to the above described embodiment, and various modifications may be made without deviating from the spirit and scope of the disclosure. The following describes such modifications one by one.

(1) When the Correction Value is Variably Set by Tape Type

That is, in the above described preparation processing performed prior to printing in the manner described above, the length of the print-receiving tape 150 (tapes 150-0, 150-1) manually pulled out by the user for connection to the winding core 41 of the take-up mechanism 40 may differ according to the type (material, thickness, and the like) of the print-receiving tape 150.

For example, in a case of the print-receiving tape 150 with high rigidity, a relatively long distance is pulled out and reliably secured to the winding core 41 of the take-up mechanism 40 due to its so-called firmness, ease of release, and the like. Conversely, in a case of the print-receiving tape 150 with low rigidity, such a phenomenon as described above does not readily occur, making it possible to secure the print-receiving tape 150 to the winding core 41 by pull-out of a relatively short pull-out distance. From such a perspective, according to this modification, as shown in FIG. 15, for example, the above described tape length correction value is set to 200 mm in a case where the print-receiving tape 150 is a PET tape, 250 mm in a case where the print-receiving tape 150 is a cloth tape or craft tape, and 150 mm in a case where the print-receiving tape is a paper tape.

Figure 16:
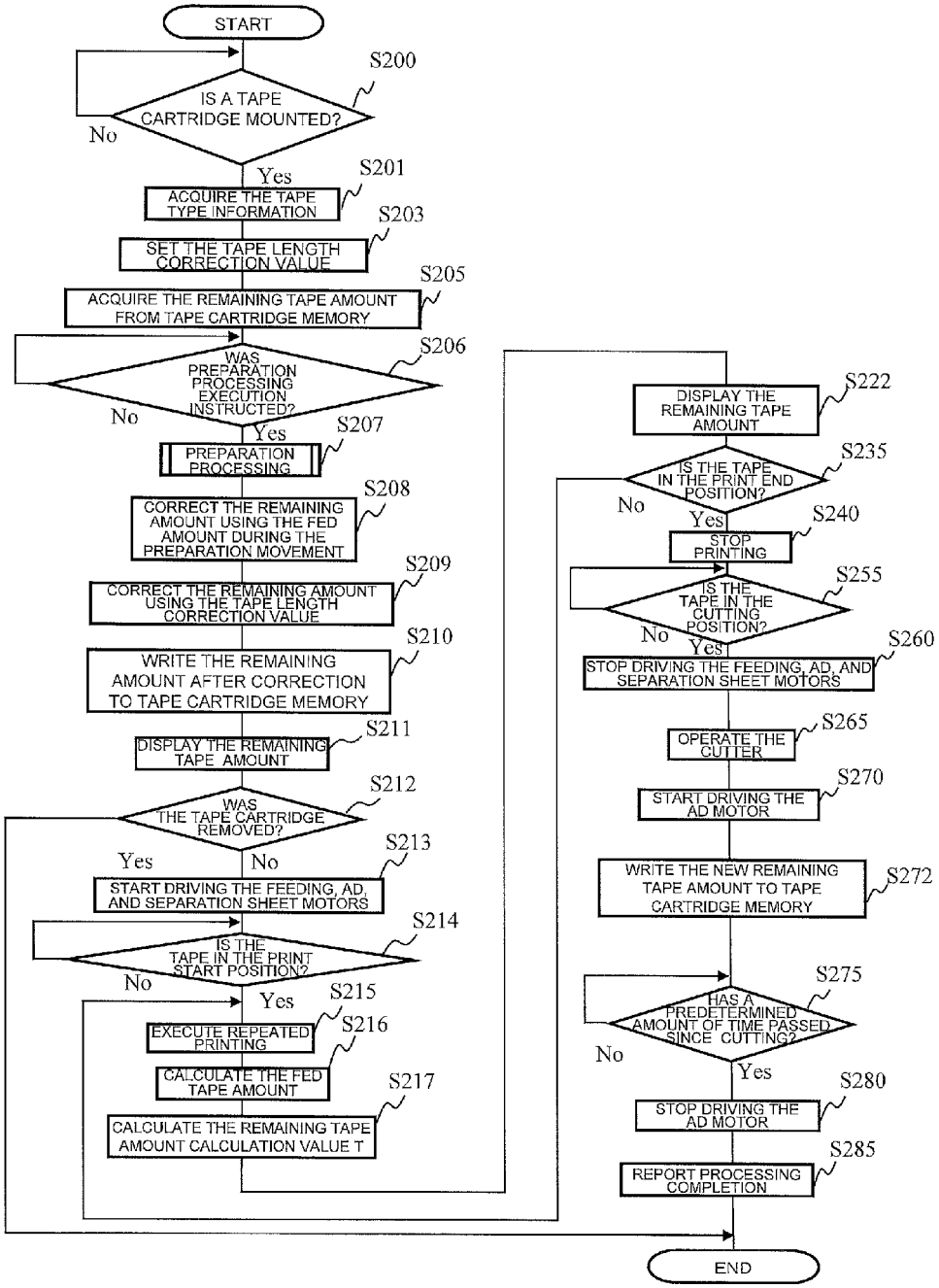
FIG. 16 is a flowchart showing the procedure of the control processing executed by the CPU of the tape printer.

FIG. 16 shows a flowchart indicating the control procedure of this modification. In the flow in this FIG. 16, step S201 and step S203 are newly disposed between step S200 and step S205 of the flow shown in the above described FIG. 13.

That is, in the step S201 following step S200, the CPU 212 acquires the type information of the print-receiving tape 150 of the tape cartridge TK by manual operation input via the operation part 216 or the PC 217 by the user (or automatically by a sensor or the like not shown).

Subsequently, in step S203, the above described tape length correction value is variably set with reference to the table in the above described FIG. 15, for example, in accordance with the type information acquired in the above described step S201.

Note that steps S203 and thereafter (steps S205-S285) are the same as those in the above described FIG. 13, and detailed descriptions thereof are omitted.

According to this modification, it is possible to reliably reflect the situation during a preparation operation such as described above, and calculate the consumed amount of the print-receiving tape 150 with higher precision.

(2) When the Correction Value is Variably Set by the Outer Diameter Dimension of the Tape Roll with Print That is, in the above described preparation processing performed prior to printing as described above, the length of the print-receiving tape 150 (tapes 150-0, 150-1) manually pulled out by the user for connection to the winding core 41 of the take-up mechanism 40 may differ according to the size of the outer diameter dimension of the winding core 41.

Figure 17A:
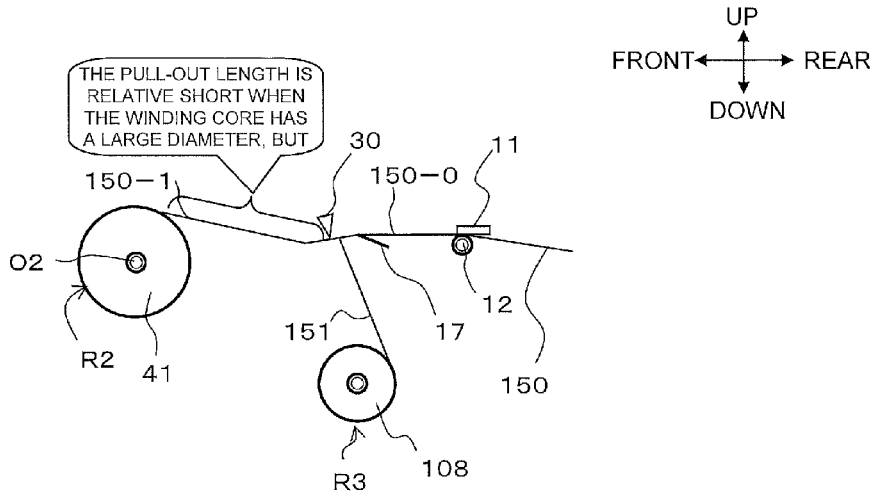
FIG. 17A is an explanatory view for explaining a modification wherein the tape length correction value is determined in accordance with outer diameter information of the winding core.

For example, FIG. 17A shows an example of a case where the winding core 41 with a relatively large diameter is used and, in this case, the above described pull-out distance is relatively short.

Figure 17B:
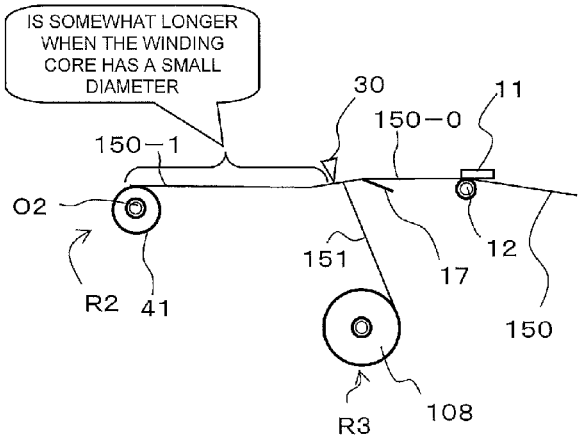
FIG. 17B is an explanatory view for explaining a modification wherein the tape length correction value is determined in accordance with outer diameter information of the winding core.

FIG. 17B shows an example of a case where the winding core 41 with a relatively small diameter is used and, in this case, the above described pull-out distance is relatively long.

Figure 18:
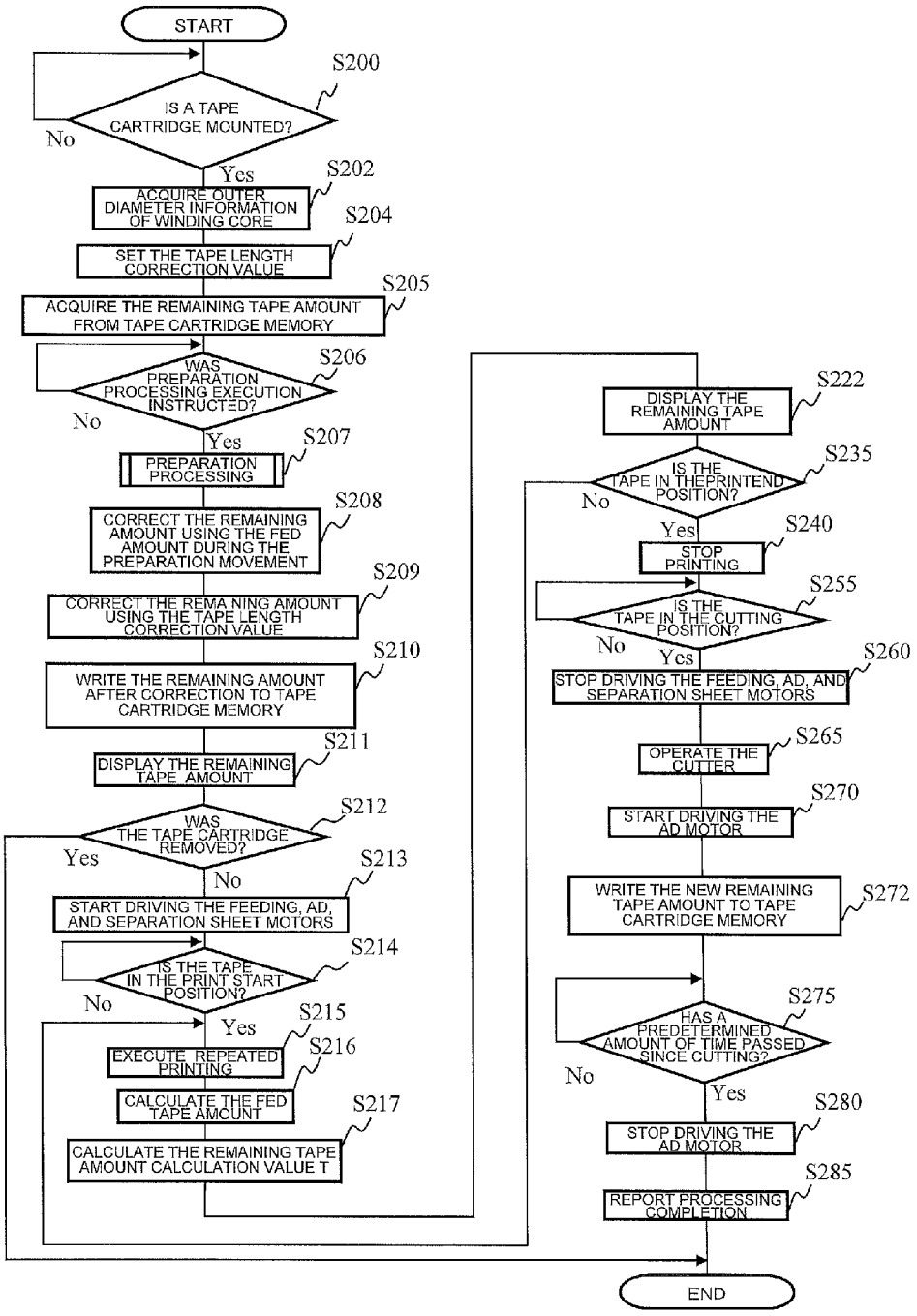
FIG. 18 is a flowchart showing the procedure of the control processing executed by the CPU of the tape printer.

FIG. 18 shows a flowchart indicating the control procedure of this modification. From such a perspective as described above, in the flow shown in FIG. 18, step S202 and step S204 are newly disposed between step S200 and step S205 of the flow shown in the above described FIG. 13.

That is, in the step S202 following the above described step S200, the CPU 212 acquires the outer diameter dimension information of the above described winding core 41 by manual operation input via the operation part 216 or the PC 217 by the user (or automatically by a sensor or the like not shown).

Subsequently, in step S204, the above described tape length correction value is variably set in accordance with the outer diameter dimension information acquired in the above described step S202.

Note that steps S204 and thereafter (steps S205-S285) are the same as those in the above described FIG. 13, and detailed descriptions thereof are omitted.

According to this modification, it is possible to reliably reflect the situation during a preparation operation such as described above, and calculate the consumed amount of the print-receiving tape 150 with higher precision.

(3) When Duplicate Preparation Processing Execution is Avoided

That is, as described above, when the above described preparation processing is performed, the operation signal that instructs execution of the preparation processing is input based on an operation (hereinafter suitably referred to as "execution instruction operation") by the user via the operation part 216 (or the above described PC 217; refer to the above described step S206). Then, in the following step S207, the above described preparation processing is executed in accordance therewith.

At this time, after the above described execution instruction operation is performed once, the same execution instruction operation may be performed again in duplicate due to user carelessness, misapprehension, or the like. This modification is designed so that the preparation processing is not executed in duplicate at the time of such a duplicate operation.

That is, in this modification, after the printing preparation processing is performed, a first flag indicating that the printing preparation processing has been performed is set and stored in a suitable location (the RAM 213 and the cartridge memory 107, for example). When the above described execution instruction operation is subsequently performed once again, the CPU 212 determines whether or not the above described first flag has been set and stored and, if the first flag is already set, does not perform the printing preparation processing in step S207 or the remaining amount correction in step S208 and step S209.

According to this modification, with the above described processing, the preparation processing is not executed in duplicate when the above described execution instruction operation has been performed in duplicate, making it possible to suppress the waste from meaningless movement.

(4) When First Flag Resetting is Supported

The processing for setting and storing the above described first flag in the modification of (3) above makes it possible to not execute the preparation processing in duplicate when the above described execution instruction operation has been performed in duplicate, as described above. Nevertheless, in order to reliably perform the preparation processing when the tape cartridge TK is newly mounted, the first flag set and stored as described above needs to be reset when the above described opening/closing covers 8*a*, 8*b* and opening/closing cover 9 are opened, for example.

Nevertheless, after the above described preparation processing has been executed once, the above described opening/closing covers 8*a*, 8*b* and opening/closing cover 9 may be opened (the above described first flag is reset at this point in time), and the same execution instruction operation may be further performed again in duplicate due to the carelessness or misapprehension of the user. In such a case, processing is performed with the above described step S125, step S130, step S135, step S140, step S145, step S150, step S155, and step S160 of the above described preparation processing omitted (that is, the take-up processing in the above described step S165, step S170 and step S175 is executed) by the control of the CPU 212. This modification supports such processing content.

That is, in this modification, if the above described execution instruction operation is performed and the above described first flag is not set (including both a case where the first flag has never been set in the past and a case where the first flag has been set but then reset by the aforementioned cover opening), the CPU 212 determines whether or not the above described tension application processing in the above described steps S125-S160 has already been executed. Specifically, after starting the driving of the separation sheet take-up motor M3 in the same manner as in the aforementioned step S145, the CPU 212 may further determine whether or not the separation material roll R3 rotates based on the detection result of the above described rotation detection sensor in the same manner as in the aforementioned step S155. The CPU 212 determines that the above described tension application processing has already been executed if the separation material roll R3 does not rotate, and that the above described tension application processing has not been executed if the separation material roll R3 rotates.

If the CPU 212 determines that the above described tension application processing has already been executed, calculation and correction of the fed tape amount in the above described step S178 and step S208 are performed in response to the execution of the take-up processing in the above described steps S165-S175, and correction using the above described tape length correction value (step S209) is not performed in response to non-execution of the tension application processing in the above described steps S125-S160.

According to this modification, with the above described processing, after the above described tension application processing and the above described take-up processing are executed once in the preparation processing, it is possible to properly correct only the take-up processing without correcting the tension application processing in duplicate, even in a case where the above described first flag is reset and the preparation processing is executed once again by the opening of one of the opening/closing covers 8*a*, 8*b*, 9, for example.

(5) Other

Note that while the remaining tape amount is stored in the tape cartridge memory 107, corrected by subtracting the fed amount (during printing processing and printed matter production) from the remaining tape amount, and further corrected by subtracting the above described tape length correction value in the above, the present disclosure is not limited thereto. That is, the consumed tape amount may be stored in the tape cartridge memory 107 (accordingly, the consumed amount is 0 when unused), corrected by adding the fed amount (during printing processing and printed matter production), and further corrected by adding the above described tape length correction value. In this case as well, the same advantages as described above are achieved.

Further, while the above described remaining tape amount (or consumed tape amount) is stored in the tape cartridge memory 107 included in the tape cartridge TK in the above, the present disclosure is not limited thereto, and the amount may be stored in association with the identification information of the respective tape cartridges TK in memory disposed in a suitable location of the tape printer 1. In this case as well, the same advantages as described above are achieved.

Note that, in the above, the arrows shown in FIG. 9 denote an example of signal flow, but the signal flow direction is not limited thereto.

Also note that the present disclosure is not limited to the procedures shown in the above described flows of the flowcharts in the above described FIG. 13, FIG. 14, FIG. 16, and FIG. 18, and procedure additions and deletions as well as sequence changes and the like may be made without deviating from the spirit and scope of the disclosure.

Further, other than that already stated above, techniques based on the above described embodiments and each of the modifications may be suitably utilized in combination as well.

What is claimed is:

1. A printer comprising:

a feeder configured to feed a long recording medium along a feeding path;

a printing head configured to perform printing on said recording medium fed by said feeder;

a cutter that is configured to cut said recording medium on which printing was performed by said printing head, and is disposed on said feeding path on a downstream side of said printing head;

a take-up portion that is configured to take up said recording medium on which printing was performed by said printing head, and is disposed on said feeding path on a downstream side of said cutter;

a first memory configured to store a value related to a remaining amount or a consumed amount of said recording medium;

a consumed amount calculating portion configured to calculate a first consumed amount of said recording medium based on a fed amount by said feeder;

a first correcting portion configured to correct the value related to a remaining amount or a consumed amount of said recording medium stored in said first memory by means of said first consumed amount calculated by said consumed amount calculating portion;

an operation signal input portion configured to input a predetermined operation signal; and a second correcting portion configured to correct the value related to a remaining amount or a consumed amount of said recording medium stored in said first memory by using a predetermined second consumed amount, triggered by input of said operation signal to said operation signal input portion.

2. The printer according to claim 1, wherein:

said first memory is arranged in a cartridge that is mountable to said printer and houses said recording medium.

3. The printer according to claim 1, wherein, triggered by input of said operation signal to said operation signal input portion, a printing preparation operation that said take-up portion takes up said recording medium while said feeder feeds said recording medium without said printing head performing printing on said recording medium is performed;

said consumed amount calculating portion calculates a consumed amount during printing preparation operation as said first consumed amount based on a fed amount of said recording medium by said feeder during said printing preparation operation; and said first correcting portion corrects the value related to a remaining amount or a consumed amount of said recording medium stored in said first memory by means of said consumed amount during printing preparation operation.

4. The printer according to claim 3, further comprising a second memory configured to set a flag indicating that said printing preparation operation has been performed when said printing preparation operation has been performed; wherein:

said printing preparation operation, the calculation of said consumed amount during printing preparation operation, the correction by said consumed amount during printing preparation operation, and the correction by using said second consumed amount are not performed in the case that said flag is set in said second memory when said operation signal is input to said operation signal input portion.

5. The printer according to claim 4, wherein:

said printing preparation operation comprises tension application processing for performing take-up by said take-up portion with feeding by said feeder stopped, and applying tension to said recording medium, and take-up processing for performing take-up of a predetermined amount of said recording medium by said take-up portion while performing feeding by said feeder;

the printer further comprises a determining portion configured to determine whether or not said tension application processing has already been executed in the case that said flag is not set in said second memory when said operation signal is input to said operation signal input portion; wherein the calculation of said consumed amount during printing preparation operation and the correction by means of said consumed amount during printing preparation operation are performed, and the correction using said second consumed amount is not performed, in the case that said determining portion determines that said tension application processing has already been executed.

6. The printer according to claim 1, wherein:

said recording medium is housed in a cartridge mountable to said printer;

said printer further comprises:

a type acquiring portion configured to acquire type information of said recording medium in said cartridge that is mounted; and a first setting portion configured to variably set said second consumed amount in accordance with said type information of said recording medium acquired by said type acquiring portion.

7. The printer according to claim 1, wherein:

said take-up portion is a winding core that comprises a predetermined axis and is configured to sequentially take up said recording medium on which printing has been performed by said printing head, around an outer circumference part of the winding core; and said printer further comprises:

an outer diameter acquiring portion configured to acquire outer diameter dimension information of said winding core; and a second setting portion configured to variably set said second consumed amount in accordance with said outer diameter dimension information of said winding core acquired by said outer diameter acquiring portion.

8. The printer according to claim 1, wherein:

said value related to a remaining amount or a consumed amount is a length of said recording medium or a number of pulses of a pulse signal output to a pulse motor that drives said feeder.

9. The printer according to claim 1, wherein:

said recording medium is arranged in a recording medium roll of a cartridge configured to be mountable to said printer, the cartridge comprising said recording medium roll that winds said recording medium and a peeling portion configured to peel a part of said recording medium fed out from said recording medium roll; and said second consumed amount is set in a fixed manner in accordance with a distance from said peeling portion to said take-up portion.

* * * * *